US009688459B2

(12) United States Patent
Stanley et al.

(10) Patent No.: US 9,688,459 B2
(45) Date of Patent: Jun. 27, 2017

(54) DISPOSABLE FLEXIBLE CONTAINERS HAVING SURFACE ELEMENTS

(71) Applicant: The Procter & Gamble Company, Cincinnati, OH (US)

(72) Inventors: Scott Kendyl Stanley, Mason, OH (US); Karl William Vanderbeek, Cincinnati, OH (US); Kenneth Stephen McGuire, Montgomery, OH (US); Lee Mathew Arent, Fairfield, OH (US); Andrew Paul Rapach, Fairfield, OH (US); Jun You, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/448,396

(22) Filed: Jul. 31, 2014

(65) Prior Publication Data

US 2015/0034670 A1 Feb. 5, 2015

Related U.S. Application Data

(60) Provisional application No. 61/861,100, filed on Aug. 1, 2013.

(51) Int. Cl.
*B65D 35/56* (2006.01)
*B65D 83/00* (2006.01)
(Continued)

(52) U.S. Cl.
CPC ..... *B65D 83/0055* (2013.01); *B05B 11/0043* (2013.01); *B65D 75/008* (2013.01);
(Continued)

(58) Field of Classification Search
CPC ..... B65D 83/0055; B65D 75/008; B65D 75/5883; B65D 77/28; B65D 33/02;
(Continued)

(56) References Cited

U.S. PATENT DOCUMENTS 3,006,396 A 10/1961 Cushman
3,171,559 A 3/1965 Ferree
(Continued)

FOREIGN PATENT DOCUMENTS

CN 201272533 7/2009
DE 102005002301 7/2006
(Continued)

OTHER PUBLICATIONS

All Office Actions, U.S. Appl. No. 13/888,679, date of filing May 7, 2013.
(Continued)

*Primary Examiner* — Frederick C Nicolas
(74) *Attorney, Agent, or Firm* — Charles R Ware; Jeffrey V Bamber

(57) ABSTRACT

A disposable flexible container for a fluent product comprises a product volume for the fluent product at least partially defined by a nonstructural panel having one or more flat spaces and one or more structural support volumes. The disposable flexible container also includes one or more surface elements generally projecting outwardly in relation to the one or more flat spaces on the nonstructural panel. Preferably, the one or more structural support volumes comprise a structural support frame configured to prevent the container from collapsing and, more preferably, they are arranged to generate and maintain tension in the nonstructural panel when they are expanded.

20 Claims, 23 Drawing Sheets

(51) Int. Cl.

| | |
|---|---|
| ***B65D 75/00*** | (2006.01) |
| ***B65D 75/58*** | (2006.01) |
| ***B65D 77/28*** | (2006.01) |
| ***B05B 11/00*** | (2006.01) |
| ***B65D 75/52*** | (2006.01) |
| *A61J 1/10* | (2006.01) |
| *B65D 81/05* | (2006.01) |
| *B65D 33/02* | (2006.01) |
| *A61J 1/12* | (2006.01) |
| *A61J 1/06* | (2006.01) |
| *B65D 35/04* | (2006.01) |
| *B65D 35/08* | (2006.01) |

(52) U.S. Cl.
CPC ..... *B65D 75/525* (2013.01); *B65D 75/5883* (2013.01); *B65D 77/28* (2013.01); *A61J 1/067* (2013.01); *A61J 1/10* (2013.01); *A61J 1/12* (2013.01); *B65D 33/02* (2013.01); *B65D 35/04* (2013.01); *B65D 35/08* (2013.01); *B65D 81/052* (2013.01)

(58) Field of Classification Search
CPC ..... B65D 81/052; B65D 35/04; B65D 35/08; B65D 75/525; B05B 11/0043; A61J 1/067; A61J 1/10; A61J 1/12
See application file for complete search history.

(56) References Cited

U.S. PATENT DOCUMENTS 3,730,240 A 5/1973 Presnick
3,742,994 A 7/1973 Pensak
3,930,286 A 1/1976 McGowen
4,044,867 A 8/1977 Fisher
4,189,456 A 2/1980 Rausing
4,384,603 A 5/1983 Tyrer et al.
4,503,558 A 3/1985 Lief et al.
4,615,926 A 10/1986 Hsu et al.
4,700,531 A 10/1987 Hsu et al.
4,700,871 A * 10/1987 Matsuo ..... A61J 1/05 222/107
4,704,314 A 11/1987 Hsu et al.
4,854,481 A 8/1989 Bohl
4,898,306 A * 2/1990 Pardes ..... B65D 1/32 222/206
4,918,904 A 4/1990 Pharo
4,949,530 A 8/1990 Pharo
4,978,025 A 12/1990 Fougeres
4,988,016 A 1/1991 Hawkins et al.
4,997,107 A * 3/1991 Snyder ..... B65D 35/02 222/107
5,074,300 A 12/1991 Murphy
5,137,154 A 8/1992 Cohen
5,174,458 A * 12/1992 Segati ..... B65D 1/0292 215/383
5,261,881 A * 11/1993 Riner ..... A61M 5/282 128/919
5,263,587 A 11/1993 Elkin et al.
5,427,830 A * 6/1995 Pharo ..... B65D 81/052 156/308.4
5,469,966 A 11/1995 Boyer
5,489,464 A 2/1996 Bjorck
5,622,283 A * 4/1997 Morrison ..... A46B 5/0095 222/103
5,692,833 A 12/1997 Deluca
5,791,485 A 8/1998 Carbonneau
5,823,391 A 10/1998 Klauke et al.
5,880,241 A 3/1999 Brookhart et al.
5,950,833 A 9/1999 James
5,960,975 A 10/1999 Lenartsson
5,971,208 A 10/1999 Kennedy
6,007,246 A 12/1999 Kinigakis et al.
6,015,235 A 1/2000 Kraimer et al.
6,176,613 B1 * 1/2001 Chen ..... B65D 33/00 206/522
6,206,569 B1 3/2001 Kraimer et al.
6,244,441 B1 6/2001 Ahlgren
6,244,466 B1 6/2001 Naslund
6,398,029 B1 6/2002 Farison
6,471,402 B1 * 10/2002 Burns ..... B65D 21/023 206/509
6,488,146 B1 * 12/2002 Dotsikas ..... A61J 7/0046 206/217
6,520,332 B1 2/2003 Barmore et al.
6,581,972 B2 6/2003 Nojima
6,607,097 B2 * 8/2003 Savage ..... B65D 75/5877 220/62.12
6,619,505 B1 9/2003 Decottignies
6,673,301 B2 * 1/2004 Cargile ..... B65D 35/08 156/203
6,682,825 B1 1/2004 Kennedy et al.
6,913,803 B2 7/2005 Peper
6,978,893 B2 12/2005 Peper
6,982,113 B2 1/2006 Kannankeril et al.
7,021,505 B2 4/2006 Franczyk
7,056,593 B2 6/2006 Kennedy et al.
7,168,566 B2 1/2007 Anderson et al.
7,168,567 B2 1/2007 Peper et al.
7,207,717 B2 4/2007 Steele
7,344,038 B2 3/2008 Elansary
7,494,279 B2 2/2009 Marquet et al.
7,585,528 B2 9/2009 Ferri
7,722,254 B2 5/2010 Murray
7,883,268 B2 2/2011 Steele
8,028,502 B2 10/2011 Murray
8,181,428 B2 5/2012 Gustafsson
8,206,033 B2 * 6/2012 Sato ..... B29C 45/14336 383/104
8,336,790 B2 * 12/2012 Kolins ..... A61L 9/042 222/206
8,464,499 B2 6/2013 Asp
8,500,330 B2 8/2013 Nomura et al.
8,661,772 B2 3/2014 Yasuhira
8,662,751 B2 3/2014 Forss
8,910,834 B2 12/2014 Becker
8,960,183 B2 * 2/2015 Husson, Jr. ..... F24J 2/36 126/624
9,327,867 B2 5/2016 Stanley et al.
9,469,088 B2 10/2016 Stanley et al.
2003/0094394 A1 5/2003 Anderson et al.
2003/0094395 A1 5/2003 Peper et al.
2003/0096068 A1 5/2003 Peper
2003/0161999 A1 8/2003 Kannankerll et al.
2003/0192909 A1 10/2003 Maskell
2004/0035865 A1 2/2004 Rosen
2004/0079764 A1 4/2004 Balz
2005/0126941 A1 6/2005 Ferri
2005/0152624 A1 7/2005 Versluys
2005/0263426 A1 12/2005 Ho
2006/0021996 A1 2/2006 Scott et al.
2006/0113269 A1 6/2006 Etesse et al.
2006/0210773 A1 9/2006 Kannankerll
2007/0003170 A1 1/2007 Yoshida
2007/0045342 A1 3/2007 Pigliacampo et al.
2007/0084745 A1 4/2007 Yoshifusa
2007/0102316 A1 5/2007 Van Der Krogt et al.
2007/0181598 A1 8/2007 Creameans et al.
2007/0267378 A1 11/2007 Piccinino et al.
2008/0149666 A1 * 6/2008 LaFlamme ..... B65D 35/40 222/105
2008/0193055 A1 8/2008 Chen et al.
2008/0193057 A1 8/2008 Nomura
2008/0230424 A1 9/2008 Chawla et al.
2008/0245804 A1 10/2008 Weinberger
2008/0277310 A1 11/2008 Chacon
2009/0307945 A1 12/2009 Bopp
2010/0061664 A1 3/2010 Gustafsson et al.
2010/0155396 A1 6/2010 Warner
2010/0308062 A1 12/2010 Helou
2011/0039098 A1 2/2011 Forloni et al.
2011/0062051 A1 3/2011 Miller

(56) References Cited

U.S. PATENT DOCUMENTS

| | | | | |
|---|---|---|---|---|
| 2011/0079608 | A1 | 4/2011 | Mamiye | |
| 2011/0290798 | A1* | 12/2011 | Corbett | B65D 11/04 220/62.12 |
| 2012/0033897 | A1 | 2/2012 | Lahr | |
| 2012/0085782 | A1 | 4/2012 | Futori | |
| 2012/0085785 | A1 | 4/2012 | Sand | |
| 2012/0097634 | A1 | 4/2012 | Riedl | |
| 2012/0125947 | A1 | 5/2012 | Becker | |
| 2012/0187069 | A1 | 7/2012 | Harris | |
| 2012/0237143 | A1 | 9/2012 | Sato et al. | |
| 2013/0015204 | A1 | 1/2013 | Gol | |
| 2013/0292287 | A1 | 11/2013 | Stanley et al. | |
| 2013/0292353 | A1 | 11/2013 | Stanley et al. | |
| 2013/0292395 | A1 | 11/2013 | Stanley et al. | |
| 2013/0292413 | A1 | 11/2013 | Stanley et al. | |
| 2013/0292415 | A1 | 11/2013 | Stanley et al. | |
| 2013/0294711 | A1 | 11/2013 | Stanley et al. | |
| 2013/0337244 | A1 | 12/2013 | Stanley et al. | |
| 2014/0033654 | A1 | 2/2014 | Stanley et al. | |
| 2014/0033655 | A1 | 2/2014 | Stanley et al. | |
| 2014/0250834 | A1 | 9/2014 | Yoshikane et al. | |
| 2015/0028057 | A1 | 1/2015 | Arent et al. | |
| 2015/0033671 | A1 | 2/2015 | Stanley et al. | |
| 2015/0034662 | A1 | 2/2015 | Stanley | |
| 2015/0034670 | A1 | 2/2015 | Stanley | |
| 2015/0036950 | A1 | 2/2015 | Stanley et al. | |
| 2015/0121810 | A1 | 5/2015 | Bourgeois et al. | |
| 2015/0122373 | A1 | 5/2015 | Bourgeois et al. | |
| 2015/0122840 | A1 | 5/2015 | Cox et al. | |
| 2015/0122841 | A1 | 5/2015 | McGuire et al. | |
| 2015/0122842 | A1 | 5/2015 | Berg et al. | |
| 2015/0122846 | A1 | 5/2015 | Stanley et al. | |
| 2015/0125099 | A1 | 5/2015 | Ishihara et al. | |
| 2015/0125574 | A1 | 5/2015 | Arent et al. | |
| 2015/0126349 | A1 | 5/2015 | Ishihara et al. | |
| 2016/0176578 | A1 | 6/2016 | Stanley et al. | |
| 2016/0176582 | A1 | 6/2016 | McGuire et al. | |
| 2016/0176583 | A1 | 6/2016 | Ishihara et al. | |
| 2016/0176584 | A1 | 6/2016 | Ishihara et al. | |
| 2016/0176597 | A1 | 6/2016 | Ishihara et al. | |
| 2016/0221727 | A1 | 8/2016 | Stanley et al. | |
| 2016/0297569 | A1 | 10/2016 | Berg et al. | |
| 2016/0297589 | A1 | 10/2016 | You et al. | |
| 2016/0297590 | A1 | 10/2016 | You et al. | |
| 2016/0297591 | A1 | 10/2016 | You et al. | |
| 2016/0325518 | A1 | 11/2016 | Ishihara et al. | |

FOREIGN PATENT DOCUMENTS

| | | |
|---|---|---|
| DE | 202005016704 | 7/2006 |
| DE | 102010001161 | 5/2010 |
| EP | 0654418 | 5/1995 |
| EP | 1964785 | 9/2008 |
| FR | 2638715 | 10/1990 |
| FR | 2801287 | 4/2002 |
| JP | A-H107159 | 1/1998 |
| JP | 2001-270533 | 10/2001 |
| JP | 2005343492 | 12/2005 |
| JP | 2006027697 | 2/2006 |
| JP | 2006044714 | 2/2006 |
| JP | 2006240651 | 9/2006 |
| JP | 2009184690 | 8/2009 |
| JP | 4639677 | 2/2011 |
| JP | 2012025394 | 2/2012 |
| RU | 2038815 | 7/1995 |
| WO | WO9601775 | 1/1996 |
| WO | WO02085729 | 10/2002 |
| WO | WO03051740 | 6/2003 |
| WO | WO2005063589 | 7/2005 |
| WO | WO2005/108065 | 11/2005 |
| WO | WO2008064508 | 6/2008 |
| WO | WO2012/062806 | 3/2012 |
| WO | WO2012073004 | 6/2012 |
| WO | WO2013124201 | 8/2013 |

OTHER PUBLICATIONS

All Office Actions, U.S. Appl. No. 13/888,963, date of filing May 7, 2013.

All Office Actions, U.S. Appl. No. 13/888,756, date of filing May 7, 2013.

All Office Actions, U.S. Appl. No. 15/094,096, date of filing Apr. 8, 2016.

Campbell; The Rigidified Standing Pouch A Concept for Flexible Packaging; Thesis, NCSU, 1993.

"The Rigidified Standing Pouch—A Concept for Flexible Packaging", Phillip John Campbell, A Thesis Written in Partial Fulfillment of the Requirements for the Degree of Master of Industrial Design, North Carolina State University School of Design Raleigh, 1993, pp. 1-35.

International Search Report and Written Opinion, PCT/US2014/049055, date of mailing Nov. 5, 2014.

* cited by examiner

DISPOSABLE FLEXIBLE CONTAINERS HAVING SURFACE ELEMENTS

FIELD OF THE INVENTION

The present disclosure relates in general to containers, and in particular, to disposable flexible containers having surface elements thereon.

BACKGROUND OF THE INVENTION

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product volumes. A product volume can be configured to be filled with one or more fluent products. A container receives a fluent product when its product volume is filled. Once filled to a desired volume, a container can be configured to contain the fluent product in its product volume, until the fluent product is dispensed. A container contains a fluent product by providing a barrier around the fluent product. The barrier prevents the fluent product from escaping the product volume. The barrier can also protect the fluent product from the environment outside of the container. A filled product volume is typically closed off by a cap or a seal. A container can be configured to dispense one or more fluent products contained in its product volume(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties.

First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

SUMMARY OF THE INVENTION

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure.

In an exemplary embodiment, a disposable flexible container for a fluent product comprises a product volume for the fluent product at least partially defined by a nonstructural panel having one or more flat spaces and one or more structural support volumes. The disposable flexible container also includes one or more surface elements projecting outwardly in relation to the one or more flat spaces on the nonstructural panel. Preferably, the one or more structural support volumes comprise a structural support frame configured to prevent the container from collapsing and, more preferably, arranged to generate and maintain tension in the nonstructural panel when expanded.

In one embodiment, the nonstructural panel has a perimeter and the one or more structural support volumes surround about 50% of the perimeter and, preferably, about 75% of the perimeter of the nonstructural panel and, more preferably, about 100% of the perimeter of the nonstructural panel.

The one or more structural support volumes may suitably comprise a single continuous structural support volume bounding the perimeter of the nonstructural panel to define a structural support frame substantially surrounding the nonstructural panel, or the one or more structural support volumes may suitably comprise a first pair of opposed structural support volumes to generate and maintain tension in the nonstructural panel and a second pair of opposed structural support volumes to maintain the first pair of opposed structural support volumes a distance apart.

In another respect, the nonstructural panel may suitably comprise a squeeze panel formed of a flexible material wherein the product volume is at least partially between the squeeze panel and another panel also formed of a flexible material.

In one embodiment, the one or more surface elements may suitably comprise at least one nonstructural volume which defines a finger rest on the squeeze panel. In another embodiment, the one or more surface elements may suitably comprise a pattern of nonstructural volumes which projects outwardly of the one or more flat spaces on the squeeze panel. In a further embodiment, the one or more surface elements may suitably comprise a plurality of nonstructural volumes which serve to divide the squeeze panel into multiple nonstructural subpanels. In one embodiment, the surface elements are separate pieces non-integral to the container. In other embodiments the surface elements are separate pieces joined to the surface of the container.

It will be understood and appreciated that all of the foregoing features and aspects of disposable flexible containers having surface elements in accordance with the disclosure as well as all of the additional features and aspects described more fully below may be utilized in any of a variety of different combinations all contemplated to be within the scope of the disclosure.

DETAILED DESCRIPTION OF THE INVENTION

Figure 1A:
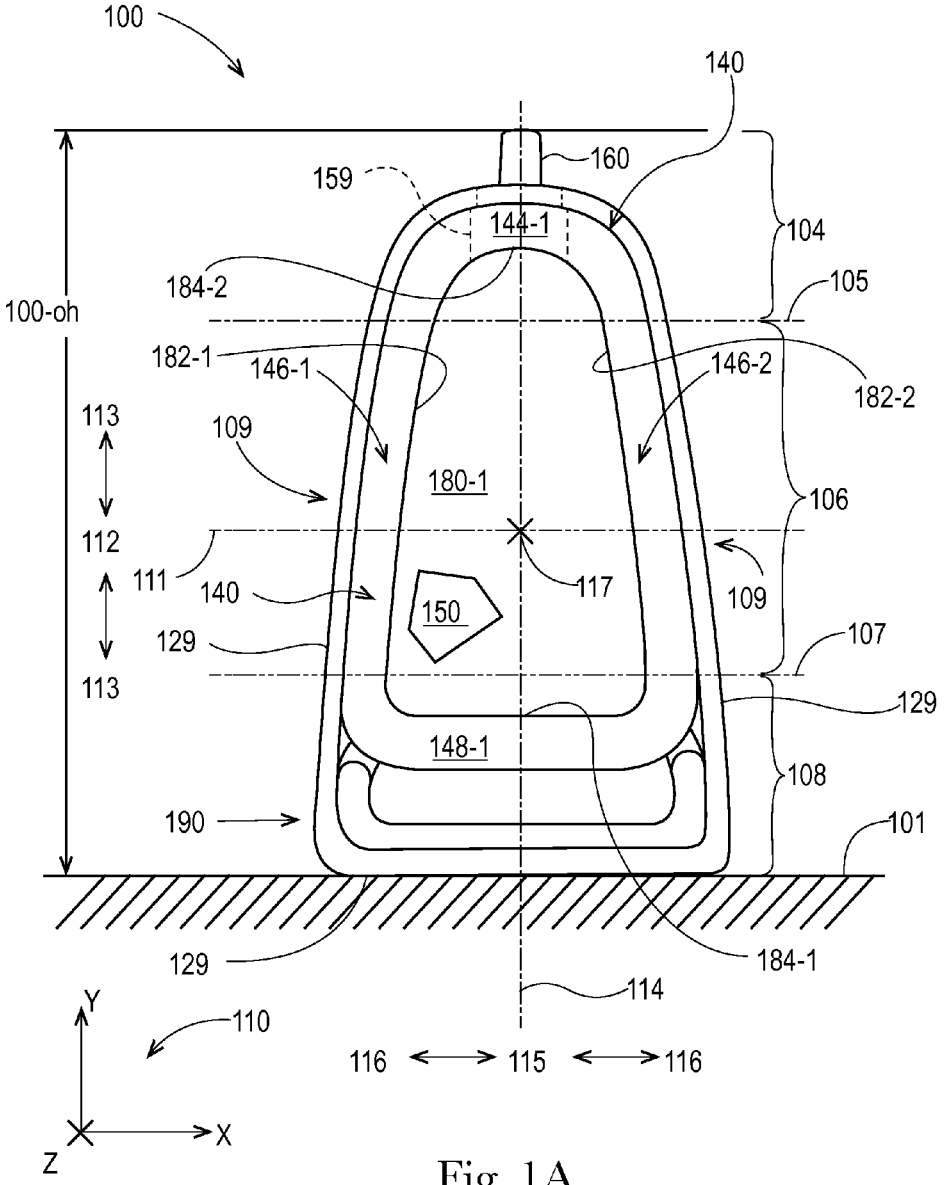
FIG. 1A illustrates a front view of an embodiment of a stand up flexible container.

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to decorate, because their flexible materials can be easily printed before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "ambient conditions" refers to a temperature within the range of 15-35 degrees Celsius and a relative humidity within the range of 35-75%.

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, when referring to a sheet of material, the term "basis weight" refers to a measure of mass per area, in units of grams per square meter (gsm). For any of the embodiments of flexible containers, disclosed herein, in various embodiments, any of the flexible materials can be configured to have a basis weight of 10-1000 gsm, or any integer value for gsm from 10-1000, or within any range formed by any of these values, such as 20-800 gsm, 30-600 gsm, 40-400 gsm, or 50-200, etc.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "branding" refers to a visual element intended to distinguish a product from other products. Examples of branding include one of more of any of the following: trademarks, trade dress, logos, icons, and the like. For any of the embodiments of flexible containers, disclosed herein, in various embodiments, any surface of the flexible container can include one or more brandings of any size, shape, or configuration, disclosed herein or known in the art, in any combination.

As used herein, the term "character" refers to a visual element intended to convey information. Examples of characters include one or more of any of the following: letters, numbers, symbols, and the like. For any of the embodiments of flexible containers, disclosed herein, in various embodiments, any surface of the flexible container can include one or more characters of any size, shape, or configuration, disclosed herein or known in the art, in any combination.

As used herein, the term "closed" refers to a state of a product volume, wherein fluent products within the product volume are prevented from escaping the product volume (e.g. by one or more materials that form a barrier, and by a cap), but the product volume is not necessarily hermetically sealed. For example, a closed container can include a vent, which allows a head space in the container to be in fluid communication with air in the environment outside of the container.

As used herein, the term "directly connected" refers to a configuration wherein elements are attached to each other without any intermediate elements therebetween, except for any means of attachment (e.g. adhesive).

As used herein, when referring to a flexible container, the term "dispenser" refers to a structure configured to dispense fluent product(s) from a product volume to the environment outside of the container. For any of the flexible containers disclosed herein, any dispenser can be configured in any way disclosed herein or known in the art. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. As another example, a dispenser can be formed by a frangible opening. As further examples, a dispenser can utilize one or more valves and/or dispensing mechanisms disclosed in the art, such as those disclosed in: published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly, or in combination with one or more other materials or structures (such as a fitment), or in any way known in the art. In some alternate embodiments, dispensers disclosed herein can be configured for both dispensing and filling, to allow filling of product volume(s) through one or more dispensers. In other alternate embodiments, a product volume can include one or filling structure(s) in addition to one or more dispenser(s).

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "effective base contact area" refers to a particular area defined by a portion of the bottom of the container, when the container (with all of its product volume(s) filled 100% with water) is standing upright and its bottom is resting on a horizontal support surface. The effective base contact area lies in a plane defined by the horizontal support surface. The effective base contact area is a continuous area bounded on all sides by an outer periphery.

The outer periphery is formed from an actual contact area and from a series of projected areas from defined cross-sections taken at the bottom of the container. The actual contact area is the one or more portions of the bottom of the container that contact the horizontal support surface, when the effective base contact area is defined. The effective base contact area includes all of the actual contact area. However, in some embodiments, the effective base contact area may extend beyond the actual contact area.

The series of projected area are formed from five horizontal cross-sections, taken at the bottom of the flexible container. These cross-sections are taken at 1%, 2%, 3%, 4%, and 5% of the overall height. The outer extent of each of these cross-sections is projected vertically downward onto the horizontal support surface to form five (overlapping) projected areas, which, together with the actual contact area, form a single combined area. This is not a summing up of the values for these areas, but is the formation of a single combined area that includes all of these (projected and actual) areas, overlapping each other, wherein any overlapping portion makes only one contribution to the single combined area.

The outer periphery of the effective base contact area is formed as described below. In the following description, the terms convex, protruding, concave, and recessed are understood from the perspective of points outside of the combined area. The outer periphery is formed by a combination of the outer extent of the combined area and any chords, which are straight line segments constructed as described below.

For each continuous portion of the combined area that has an outer perimeter with a shape that is concave or recessed, a chord is constructed across that portion. This chord is the shortest straight line segment that can be drawn tangent to the combined area on both sides of the concave/recessed portion.

For a combined area that is discontinuous (formed by two or more separate portions), one or more chords are constructed around the outer perimeter of the combined area, across the one or more discontinuities (open spaces disposed between the portions). These chords are straight lines segments drawn tangent to the outermost separate portions of the combined area. These chords are drawn to create the largest possible effective base contact area.

Thus, the outer periphery is formed by a combination of the outer extent of the combined area and any chords, constructed as described above, which all together enclose the effective base area. Any chords that are bounded by the combined area and/or one or more other chords, are not part of the outer periphery and should be ignored.

Any of the embodiments of flexible containers, disclosed herein, can be configured to have an effective base contact area from 1 to 50,000 square centimeters ($cm^2$), or any integer value for $cm^2$ between 1 and 50,000 $cm^2$, or within any range formed by any of the preceding values, such as: from 2 to 25,000 $cm^2$, 3 to 10,000 $cm^2$, 4 to 5,000 $cm^2$, 5 to 2,500 $cm^2$, from 10 to 1,000 $cm^2$, from 20 to 500 $cm^2$, from 30 to 300 $cm^2$, from 40 to 200 $cm^2$, or from 50 to 100 $cm^2$, etc.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product volume(s) are filled with fluent product(s), before or after the flexible container is shipped to a seller, and before or after the flexible container is purchased by an end user.

As used herein, when referring to a product volume of a flexible container, the term "filled" refers to the state when the product volume contains an amount of fluent product(s) that is equal to a full capacity for the product volume, with an allowance for head space, under ambient conditions. As used herein, the term filled can be modified by using the term filled with a particular percentage value, wherein 100% filled represents the maximum capacity of the product volume.

As used herein, the term "flat" refers to a surface that is without significant projections or depressions.

As used herein, the term "flexible container" refers to a container configured to have a product volume, wherein one or more flexible materials form 50-100% of the overall surface area of the one or more materials that define the three-dimensional space of the product volume. For any of the embodiments of flexible containers, disclosed herein, in various embodiments, the flexible container can be configured to have a product volume, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art. In various embodiments, part, parts, or all of a flexible material can be coated or uncoated, treated or untreated, processed or unprocessed, in any manner known in the art. In various embodiments, parts, parts, or all of a flexible material can made of sustainable, bio-sourced, recycled, recyclable, and/or biodegradable material. Part, parts, or all of any of the flexible materials described herein can be partially or completely translucent, partially or completely transparent, or partially or completely opaque. The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product volumes disclosed herein can be configured to include one or more of any fluent product disclosed herein, or known in the art, in any combination.

As used herein, when referring to a flexible container, the term "formed" refers to the state of one or more materials that are configured to be formed into a product volume, after the product volume is provided with its defined three-dimensional space.

As used herein, the term "graphic" refers to a visual element intended to provide a decoration or to communicate information. Examples of graphics include one or more of any of the following: colors, patterns, designs, images, and the like. For any of the embodiments of flexible containers, disclosed herein, in various embodiments, any surface of the flexible container can include one or more graphics of any size, shape, or configuration, disclosed herein or known in the art, in any combination.

As used herein, when referring to a flexible container, the term "height area ratio" refers to a ratio for the container, with units of per centimeter ($cm^{-1}$), which is equal to the value for the overall height of the container (with all of its product volume(s) filled 100% with water, and with overall height measured in centimeters) divided by the value for the effective base contact area of the container (with all of its product volume(s) filled 100% with water, and with effective base contact area measured in square centimeters). For any of the embodiments of flexible containers, disclosed herein, in various embodiments, any of the flexible containers, can be configured to have a height area ratio from 0.3 to 3.0 per centimeter, or any value in increments of 0.05 $cm^{-1}$ between 0.3 and 3.0 per centimeter, or within any range formed by any of the preceding values, such as: from 0.35 to 2.0 $cm^{-1}$, from 0.4 to 1.5 $cm^{-1}$, from 0.4 to 1.2 $cm^{-1}$, or from 0.45 to 0.9 $cm^{-1}$, etc.

As used herein, the term "indicia" refers to one or more of characters, graphics, branding, or other visual elements, in any combination. For any of the embodiments of flexible containers, disclosed herein, in various embodiments, any surface of the flexible container can include one or more indicia of any size, shape, or configuration, disclosed herein or known in the art, in any combination.

As used herein, the term "indirectly connected" refers to a configuration wherein elements are attached to each other with one or more intermediate elements therebetween.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright on a horizontal support surface, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with a differing first digit, wherein that first digit matches the number for its figure; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "longitudinal" refers to a direction, orientation, or measurement that is parallel to a longitudinal centerline of a container, when the container is standing upright on a horizontal support surface, as described herein. A longitudinal orientation may also be referred to a "vertical" orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, when referring to a product volume, the term "multiple dose" refers to a product volume that is sized to contain a particular amount of product that is about equal to two or more units of typical consumption, application, or use by an end user. Any of the embodiments of flexible containers, disclosed herein, can be configured to have one or more multiple dose product volumes. A container with only one product volume, which is a multiple dose product volume, is referred to herein as a "multiple dose container."

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "overall height" refers to a distance that is measured while the container is standing upright on a horizontal support surface, the distance measured vertically from the upper side of the support surface to a point on the top of the container, which is farthest away from the upper side of the support surface. Any of the embodiments of flexible containers, disclosed herein, can be configured to have an overall height from 2.0 cm to 100.0 cm, or any value in increments of 0.1 cm between 2.0 and 100.0 cm, or within any range formed by any of the preceding values, such as: from 4.0 to 90.0 cm, from 5.0 to 80.0 cm, from 6.0 to 70.0 cm, from 7.0 to 60.0 cm, from 8.0 to 50.0 cm, from 9.0 to 40.0 cm, or from 10.0 to 30.0, etc.

As used herein, when referring to a sheet of flexible material, the term "overall thickness" refers to a linear dimension measured perpendicular to the outer major surfaces of the sheet, when the sheet is lying flat. For any of the embodiments of flexible containers, disclosed herein, in various embodiments, any of the flexible materials can be configured to have an overall thickness 5-500 micrometers (μm), or any integer value for micrometers from 5-500, or within any range formed by any of these values, such as 10-500 μm, 20-400 μm, 30-300 μm, 40-200 μm, or 50-100 μm, etc.

As used herein, the term "product volume" refers to an enclosable three-dimensional space that is configured to receive and directly contain one or more fluent product(s), wherein that space is defined by one or more materials that form a barrier that prevents the fluent product(s) from escaping the product volume. By directly containing the one or more fluent products, the fluent products come into contact with the materials that form the enclosable three-dimensional space; there is no intermediate material or container, which prevents such contact. Throughout the present disclosure the terms "product volume" and "product receiving volume" are used interchangeably and are intended to have the same meaning. Any of the embodiments of flexible containers, disclosed herein, can be configured to have any number of product volumes including one product volume, two product volumes, three product volumes, four product volumes, five product volumes, six product volumes, or even more product volumes. Any of the product volumes disclosed herein can have a product volume of any size, including from 0.001 liters to 100.0 liters, or any value in increments of 0.001 liters between 0.001 liters and 3.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product volume can have any shape in any orientation. A product volume can be included in a container that has a structural support frame, and a product volume can be included in a container that does not have a structural support frame.

As used herein, when referring to a flexible container, the term "resting on a horizontal support surface" refers to the container resting directly on the horizontal support surface, without other support.

As used herein, the term "sealed," when referring to a product volume, refers to a state of the product volume wherein fluent products within the product volume are prevented from escaping the product volume (e.g. by one or more materials that form a barrier, and by a seal), and the product volume is hermetically sealed.

As used herein, when referring to a flexible container, the term "self-supporting" refers to a container that includes a product volume and a structural support frame, wherein, when the container is resting on a horizontal support surface, in at least one orientation, the structural support frame is configured to prevent the container from collapsing and to give the container an overall height that is significantly greater than the combined thickness of the materials that form the container, even when the product volume is unfilled. Any of the embodiments of flexible containers, disclosed herein, can be configured to be self-supporting.

As used herein, when referring to a flexible container, the term "single use" refers to a closed container which, after being opened by an end user, is not configured to be reclosed. Any of the embodiments of flexible containers, disclosed herein, can be configured to be single use.

As used herein, when referring to a product volume, the term "single dose" refers to a product volume that is sized to contain a particular amount of product that is about equal to one unit of typical consumption, application, or use by an end user. Any of the embodiments of flexible containers, disclosed herein, can be configured to have one or more single dose product volumes. A container with only one product volume, which is a single dose product volume, is referred to herein as a "single dose container."

As used herein, when referring to a flexible container, the terms "stand up," "stands up," "standing up", "stand upright", "stands upright", and "standing upright" refer to a particular orientation of a self-supporting flexible container, when the container is resting on a horizontal support surface. This standing upright orientation can be determined from the structural features of the container and/or indicia on the container. In a first determining test, if the flexible container has a clearly defined base structure that is configured to be used on the bottom of the container, then the container is determined to be standing upright when this base structure is resting on the horizontal support surface. If the first test cannot determine the standing upright orientation, then, in a second determining test, the container is determined to be standing upright when the container is oriented to rest on the horizontal support surface such that the indicia on the flexible container are best positioned in an upright orientation. If the second test cannot determine the standing upright orientation, then, in a third determining test, the container is determined to be standing upright when the container is oriented to rest on the horizontal support surface such that the container has the largest overall height. If the third test cannot determine the standing upright orientation, then, in a fourth determining test, the container is determined to be standing upright when the container is oriented to rest on the horizontal support surface such that the container has the largest height area ratio. If the fourth test cannot determine the standing upright orientation, then, any orientation used in the fourth determining test can be considered to be a standing upright orientation.

As used herein, when referring to a flexible container, the term "stand up container" refers to a self-supporting container, wherein, when the container (with all of its product volume(s) filled 100% with water) is standing up, the container has a height area ratio from 0.4 to 1.5 $cm^{-1}$. Any of the embodiments of flexible containers, disclosed herein, can be configured to be stand up containers.

As used herein, when referring to a flexible container, the term "nonstructural panel" refers to flexible material(s) and/or laminate(s) of flexible material(s) which have at least one flat space and overlay a product volume disposed within the flexible container.

As used herein, a "flat space" is any relatively smooth or uniform outer surface portion of a nonstructural panel not characterized by any peaks or depressions and which comprises the outer surface portion from which a surface element projects.

As used herein, a "surface element" is a protrusion that locally extends out in a direction substantially normal to a flat space to a height or distance that is at least about 1 micrometer (μm) or any integer value for micrometers from about 1 to about 30,000 micrometers (μm).

As used herein, a "flexible squeeze panel" is a nonstructural panel that is under tension generated and maintained across the nonstructural panel by a structural support member such as a structural support volume when expanded.

As used herein, a "nonstructural volume" is an expandable volume which does not contribute significantly to preventing a container from collapsing or to generating and maintaining tension in a nonstructural panel when expanded.

As used herein, when referring to a flexible container, the term "structural support frame" refers to a rigid structure formed of one or more structural support members, joined together, around one or more sizable empty or flat spaces and/or one or more nonstructural panels, and generally used as a major support in making the container self-supporting and/or standing upright.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or all of a structural support member can be straight, curved, angled, segmented, or other shapes, or combinations of any of these shapes. Part, parts, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or all of a length. A structural support member can have any suitable cross-sectional area, any suitable overall width, and any suitable overall length. A structural support member can be substantially uniform along part, parts, or all of its length, or can vary, in any way described herein, along part, parts, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multilayer panel), and structures with flexible materials that are not configured to be expanded by an expansion material (e.g. a space in a structure that is configured to be a non-structural panel). Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thickness" refers to a measurement that is parallel to a third centerline of a container, when the container is standing upright on a horizontal support surface, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to a flexible container, the term "unexpanded" refers to the state of one or more materials that are configured to be formed into a structural support volume, before the structural support volume is made rigid by an expansion material.

As used herein, when referring to a product volume of a flexible container, the term "unfilled" refers to the state of the product volume when it does not contain a fluent product.

As used herein, when referring to a flexible container, the term "unformed" refers to the state of one or more materials that are configured to be formed into a product volume, before the product volume is provided with its defined three-dimensional space. For example, an article of manufacture could be a container blank with an unformed product volume, wherein sheets of flexible material, with portions joined together, are laying flat against each other.

Flexible containers, as described herein, may be used across a variety of industries for a variety of products. For example, flexible containers, as described herein, may be used across the consumer products industry, including the following products: soft surface cleaners, hard surface cleaners, glass cleaners, ceramic tile cleaners, toilet bowl cleaners, wood cleaners, multi-surface cleaners, surface disinfectants, dishwashing compositions, laundry detergents, fabric conditioners, fabric dyes, surface protectants, surface disinfectants, cosmetics, facial powders, body powders, hair treatment products (e.g. mousse, hair spray, styling gels), shampoo, hair conditioner (leave-in or rinse-out), cream rinse, hair dye, hair coloring product, hair shine product, hair serum, hair anti-frizz product, hair split-end repair products, permanent waving solution, antidandruff formulation, bath gels, shower gels, body washes, facial cleaners, skin care products (e.g. sunscreen, sun block lotions, lip balm, skin conditioner, cold creams, moisturizers), body sprays, soaps, body scrubs, exfoliants, astringent, scrubbing lotions, depilatories, antiperspirant compositions, deodorants, shaving products, pre-shaving products, after shaving products, toothpaste, mouthwash, etc. As further examples, flexible containers, as described herein, may be used across other industries, including foods, beverages, pharmaceuticals, commercial products, industrial products, medical, etc.

FIGS. 1A-1D illustrates various views of an embodiment of a stand up flexible container 100. FIG. 1A illustrates a front view of the container 100. The container 100 is standing upright on a horizontal support surface 101.

In FIG. 1A, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIG. 1A also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. When a first location is nearer to the lateral centerline 111 than a second location, the first location is considered to be disposed longitudinally inboard 112 to the second location. And, the second location is considered to be disposed longitudinally outboard 113 from the first location. The term lateral refers to a direction, orientation, or measurement that is parallel to the lateral centerline 111. A lateral orientation may also be referred to a horizontal orientation, and a lateral measurement may also be referred to as a width.

A disposition with respect to the longitudinal centerline 114 defines what is laterally inboard 115 and laterally outboard 116. When a first location is nearer to the longitudinal centerline 114 than a second location, the first location is considered to be disposed laterally inboard 115 to the second location. And, the second location is considered to be disposed laterally outboard 116 from the first location. The term longitudinal refers to a direction, orientation, or measurement that is parallel to the longitudinal centerline 114. A longitudinal orientation may also be referred to a vertical orientation.

A longitudinal direction, orientation, or measurement may also be expressed in relation to a horizontal support surface for the container 100. When a first location is nearer to the support surface than a second location, the first location can be considered to be disposed lower than, below, beneath, or under the second location. And, the second location can be considered to be disposed higher than, above, or upward from the first location. A longitudinal measurement may also be referred to as a height, measured above the horizontal support surface 100.

A measurement that is made parallel to the third centerline 117 is referred to a thickness or depth. A disposition in the direction of the third centerline 117 and toward a front 102-1 of the container is referred to as forward 118 or in front of. A disposition in the direction of the third centerline 117 and toward a back 102-2 of the container is referred to as backward 119 or behind.

These terms for direction, orientation, measurement, and disposition, as described above, are used for all of the embodiments of the present disclosure, whether or not a support surface, reference line, or coordinate system is shown in a figure.

The container 100 includes a top 104, a middle 106, and a bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-oh. In the embodiment of FIG. 1A, the front 102-1 and the back 102-2 of the container are joined together at a seal 129, which extends around the outer periphery of the container 100, across the top 104, down the side 109, and then, at the bottom of each side 109, splits outward to follow the front and back portions of the base 190, around their outer extents.

The container 100 includes a structural support frame 140, a product volume 150, a dispenser 160, panels 180-1 and 180-2, and a base structure 190. A portion of panel 180-1 is illustrated as broken away, in order to show the product volume 150. The product volume 150 is configured to contain one or more fluent products. The dispenser 160 allows the container 100 to dispense these fluent product(s) from the product volume 150 through a flow channel 159 then through the dispenser 160, to the environment outside of the container 100. The structural support frame 140 supports the mass of fluent product(s) in the product volume 150, and makes the container 100 stand upright. The panels 180-1 and 180-2 are relatively flat surfaces, overlaying the product volume 150, and are suitable for displaying any kind of indicia. The base structure 190 supports the structural support frame 140 and provides stability to the container 100 as it stands upright.

The structural support frame 140 is formed by a plurality of structural support members. The structural support frame 140 includes top structural support members 144-1 and 144-2, middle structural support members 146-1, 146-2, 146-3, and 146-4, as well as bottom structural support members 148-1 and 148-2.

The top structural support members 144-1 and 144-2 are disposed on the upper part of the top 104 of the container 100, with the top structural support member 144-1 disposed in the front 102-1 and the top structural support member 144-2 disposed in the back 102-2, behind the top structural support member 144-1. The top structural support members 144-1 and 144-2 are adjacent to each other and can be in contact with each other along the laterally outboard portions of their lengths. In various embodiments, the top structural support members 144-1 and 144-2 can be in contact with each other at one or more relatively smaller locations and/or at one or more relatively larger locations, along part, or parts, or about all, or approximately all, or substantially all, or nearly all of their overall lengths, so long as there is a flow channel 159 between the top structural support members 144-1 and 144-2, which allows the container 100 to dispense fluent product(s) from the product volume 150 through the flow channel 159 then through the dispenser 160. The top structural support members 144-1 and 144-2 are not directly connected to each other. However, in various alternate embodiments, the top structural support members 144-1 and 144-2 can be directly connected and/or joined together along part, or parts, or about all, or approximately all, or substantially all, or nearly all, or all of their overall lengths.

The top structural support members 144-1 and 144-2 are disposed substantially above the product volume 150. Overall, each of the top structural support members 144-1 and 144-2 is oriented about horizontally, but with its ends curved slightly downward. And, overall each of the top structural support members 144-1 and 144-2 has a cross-sectional area that is substantially uniform along its length; however the cross-sectional area at their ends are slightly larger than the cross-sectional area in their middles.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and can be in contact with each other along substantially all of their lengths. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and can be in contact with each other along substantially all of their lengths. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product volume 150. Overall, each of the middle structural support members 146-1, 146-2, 146-3, and 146-4 is oriented about vertically, but angled slightly, with its upper end laterally inboard to its lower end. And, overall each of the middle structural support members 146-1, 146-2, 146-3, and 146-4 has a cross-sectional area that changes along its length, increasing in size from its upper end to its lower end.

The bottom structural support members 148-1 and 148-2 are disposed on the bottom 108 of the container 100, with the bottom structural support member 148-1 disposed in the front 102-1 and the bottom structural support member 148-2 disposed in the back 102-2, behind the top structural support member 148-1. The bottom structural support members 148-1 and 148-2 are adjacent to each other and can be in contact with each other along substantially all of their lengths. In various embodiments, the bottom structural support members 148-1 and 148-2 can be in contact with each other at one or more relatively smaller locations and/or at one or more relatively larger locations, along part, or parts, or about all, or approximately all, or substantially all, or nearly all, or all of their overall lengths. The bottom structural support members 148-1 and 148-2 are not directly connected to each other. However, in various alternate embodiments, the bottom structural support members 148-1 and 148-2 can be directly connected and/or joined together along part, or parts, or about all, or approximately all, or substantially all, or nearly all, or all of their overall lengths.

The bottom structural support members 148-1 and 148-2 are disposed substantially below the product volume 150, but substantially above the base structure 190. Overall, each of the bottom structural support members 148-1 and 148-2 is oriented about horizontally, but with its ends curved slightly upward. And, overall each of the bottom structural support members 148-1 and 148-2 has a cross-sectional area that is substantially uniform along its length.

In the front portion of the structural support frame 140, the left end of the top structural support member 144-1 is joined to the upper end of the middle structural support member 146-1; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is joined to the right end of the top structural support member 144-1. Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. In the structural support frame 140, the ends of the structural support members, which are joined together, are directly connected, all around the periphery of their walls. However, in various alternative embodiments, any of the structural support members 144-1, 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein. Also, in some alternative embodiments, a flexible container may not include a base structure.

Figure 1B:
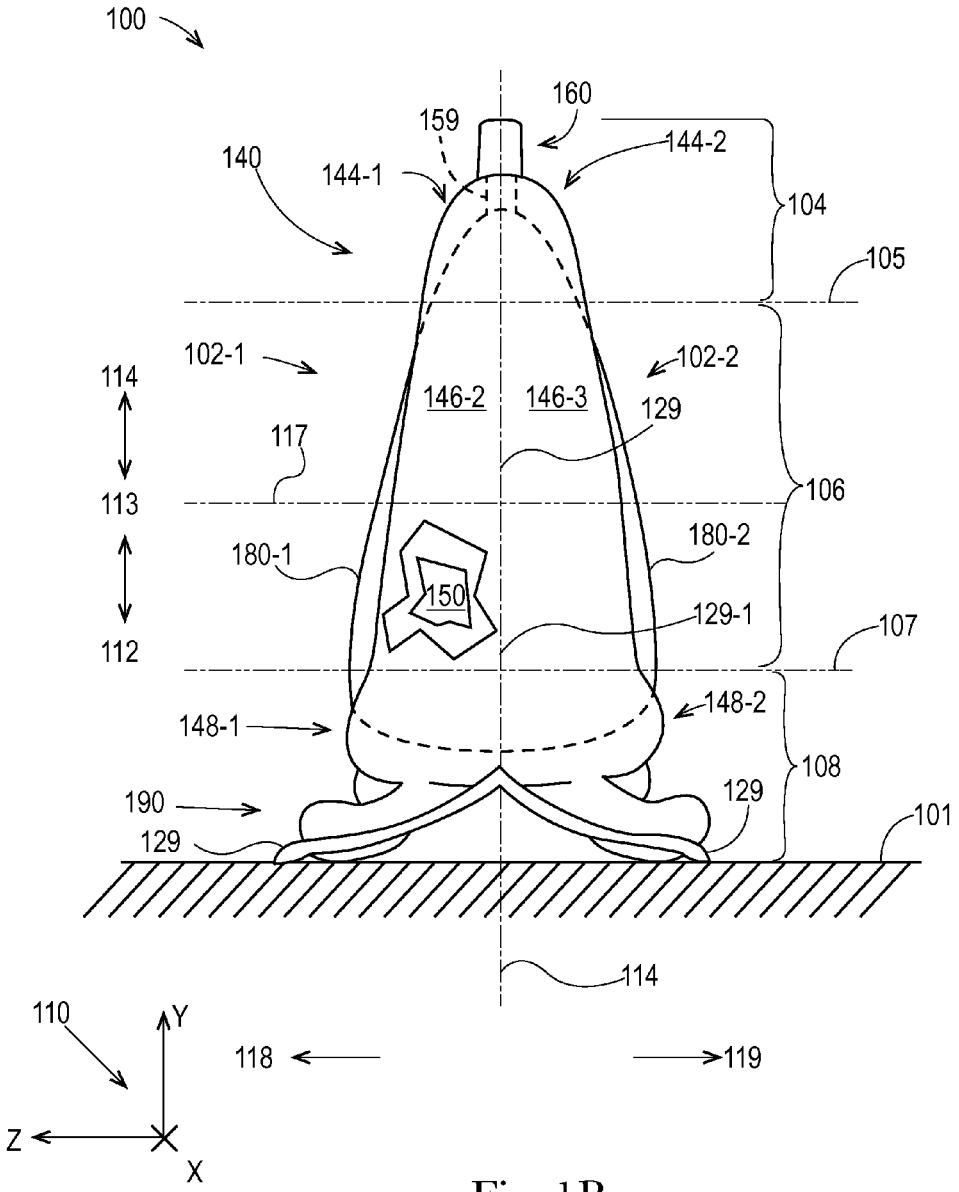
FIG. 1B illustrates a side view of the stand up flexible container of FIG. 1A.

FIG. 1B illustrates a side view of the stand up flexible container 100 of FIG. 1A.

Figure 1C:
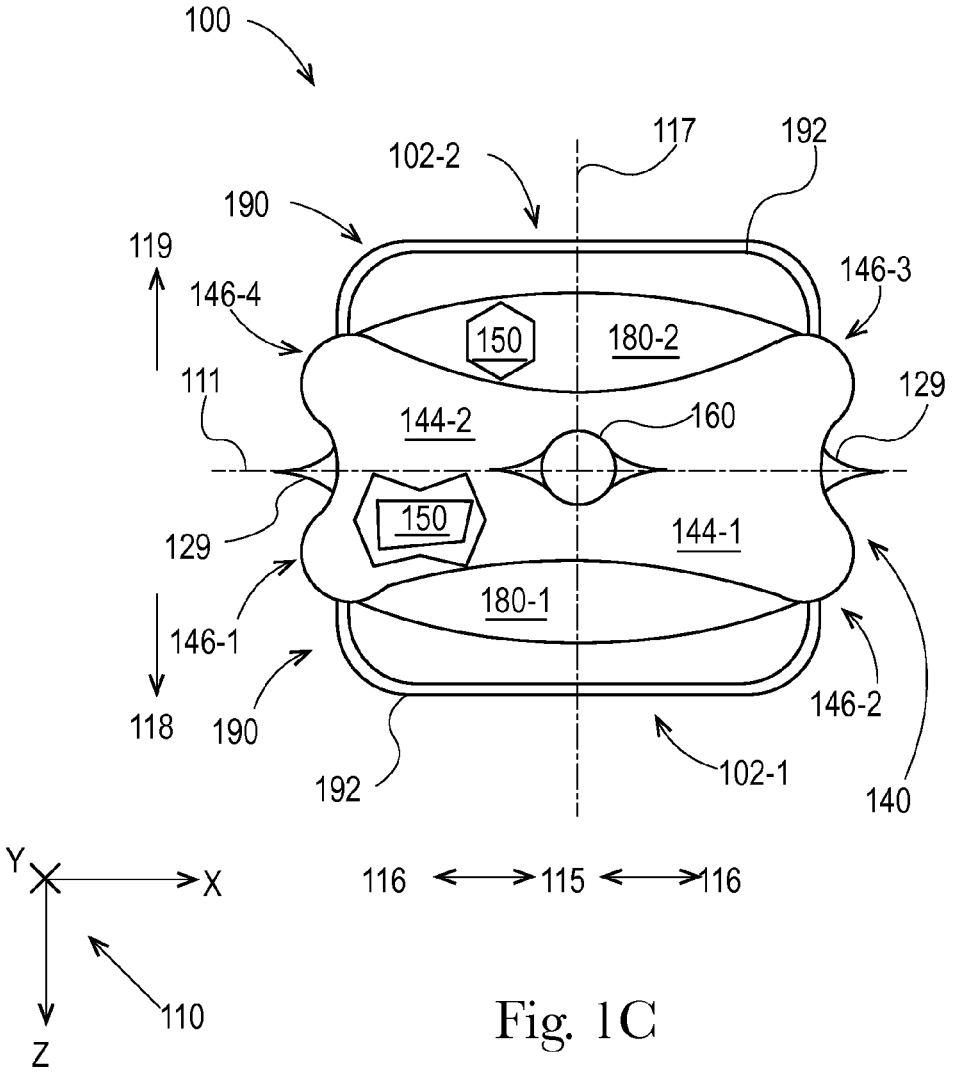
FIG. 1C illustrates a top view of the stand up flexible container of FIG. 1A.

FIG. 1C illustrates a top view of the stand up flexible container 100 of FIG. 1A.

Figure 1D:
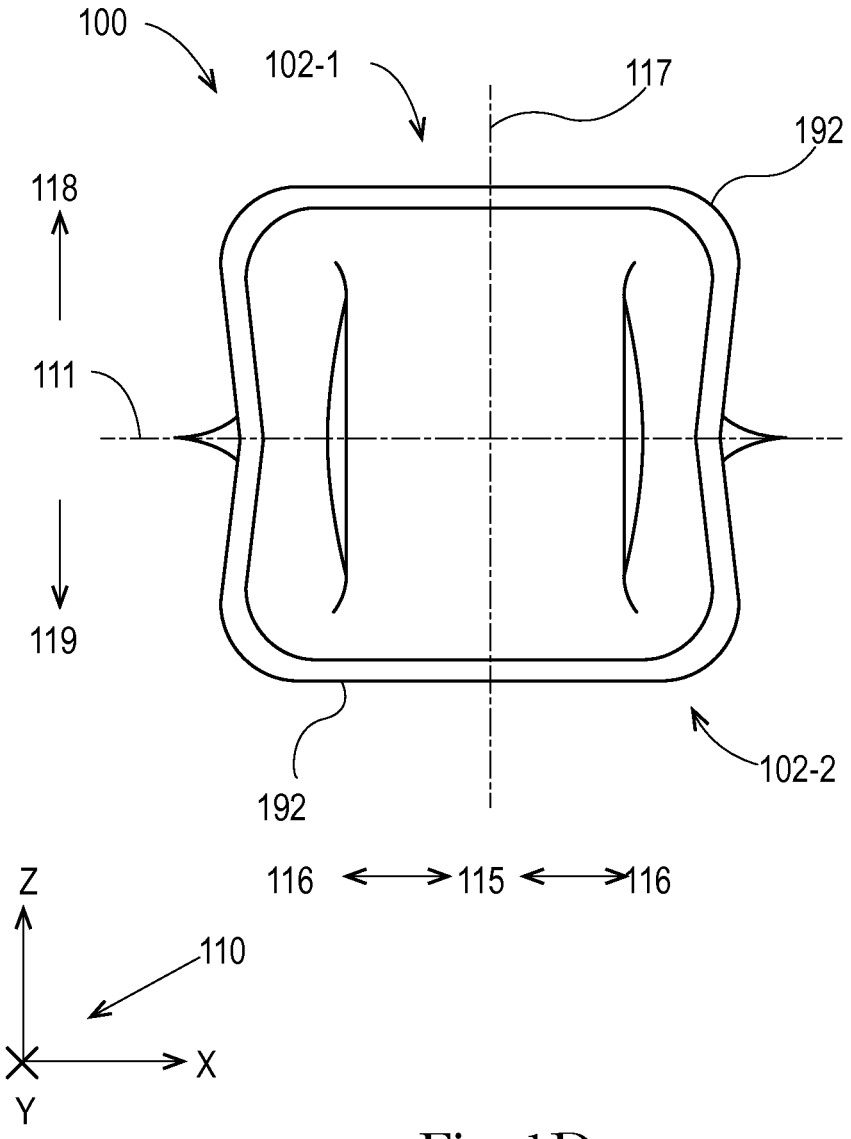
FIG. 1D illustrates a bottom view of the stand up flexible container of FIG. 1A.

FIG. 1D illustrates a bottom view of the stand up flexible container 100 of FIG. 1A.

FIGS. 2A-8D illustrate embodiments of stand-up flexible containers having various overall shapes. Any of the embodiments of FIGS. 2A-8D can be configured according to any of the embodiments disclosed herein, including the embodiments of FIGS. 1A-1D. Any of the elements (e.g. structural support frames, structural support members, panels, dispensers, etc.) of the embodiments of FIGS. 2A-8D, can be configured according to any of the embodiments disclosed herein. While each of the embodiments of FIGS. 2A-8D illustrates a container with one dispenser, in various embodiments, each container can include multiple dispensers, according to any embodiment described herein. Part, parts, or all of each of the panels in the embodiments of FIGS. 2A-8D is suitable to display any kind of indicia. Each of the side panels in the embodiments of FIGS. 2A-8D is configured to be a nonstructural panel, overlaying product volume(s) disposed within the flexible container, however, in various embodiments, one or more of any kind of decorative or structural element (such as a rib, protruding from an outer surface) can be joined to part, parts, or all of any of these side panels. For clarity, not all structural details of these flexible containers are shown in FIGS. 2A-8D, however any of the embodiments of FIGS. 2A-8D can be configured to include any structure or feature for flexible containers, disclosed herein. For example, any of the embodiments of FIGS. 2A-8D can be configured to include any kind of base structure disclosed herein.

Figure 2A:
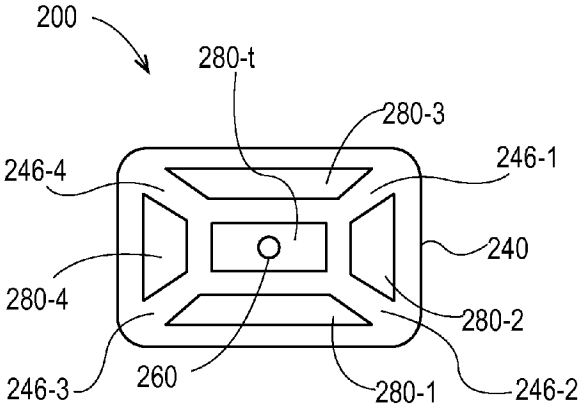
FIG. 2A illustrates a top view of a stand up flexible container having a structural support frame that has an overall shape like a frustum.

FIG. 2A illustrates a front view of a stand up flexible container 200 having a structural support frame 240 that has an overall shape like a frustum. In the embodiment of FIG.

Figure 2B:
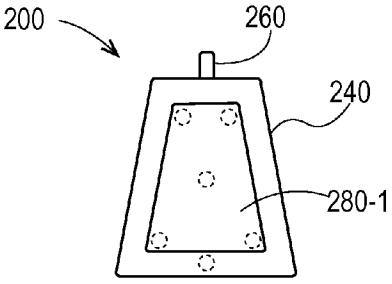
FIG. 2B illustrates a front view of the container of FIG. 2A.
Figure 2C:
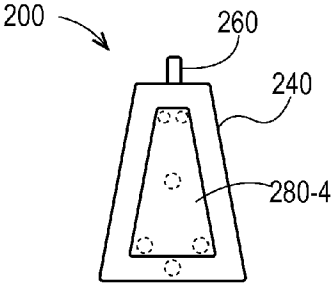
FIG. 2C illustrates a side view of the container of FIG. 2A.
Figure 2D:
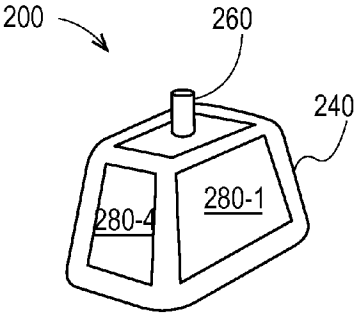
FIG. 2D illustrates an isometric view of the container of FIG. 2A.

2A, the frustum shape is based on a four-sided pyramid, however, in various embodiments, the frustum shape can be based on a pyramid with a different number of sides, or the frustum shape can be based on a cone. The support frame 240 is formed by structural support members disposed along the edges of the frustum shape and joined together at their ends. The structural support members define a rectangular shaped top panel 280-*t*, trapezoidal shaped side panels 280-1, 280-2, 280-3, and 280-4, and a rectangular shaped bottom panel (not shown). Each of the side panels 280-1, 280-2, 280-3, and 280-4 is about flat, however in various embodiments, part, parts, or all of any of the side panels can be approximately flat, substantially flat, nearly flat, or completely flat. The container 200 includes a dispenser 260, which is configured to dispense one or more fluent products from one or more product volumes disposed within the container 200. In the embodiment of FIG. 2A, the dispenser 260 is disposed in the center of the top panel 280-*t*, however, in various alternate embodiments, the dispenser 260 can be disposed anywhere else on the top, sides, or bottom, of the container 200. FIG. 2B illustrates a front view of the container 200 of FIG. 2A, including exemplary additional/alternate locations for a dispenser, any of which can also apply to the back of the container. FIG. 2C illustrates a side view of the container 200 of FIG. 2A, including exemplary additional/alternate locations for a dispenser (shown as phantom lines), any of which can apply to either side of the container. FIG. 2D illustrates an isometric view of the container 200 of FIG. 2A.

Figure 3A:
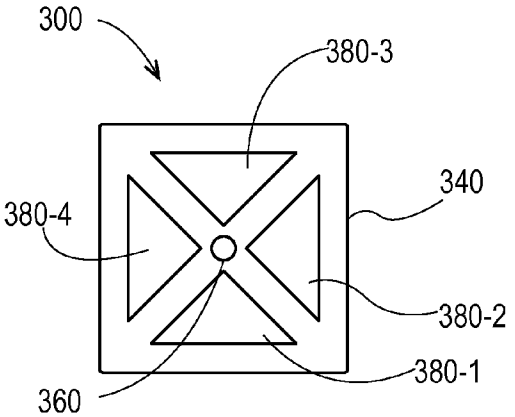
FIG. 3A illustrates a top view of a stand up flexible container having a structural support frame that has an overall shape like a pyramid.
Figure 3B:
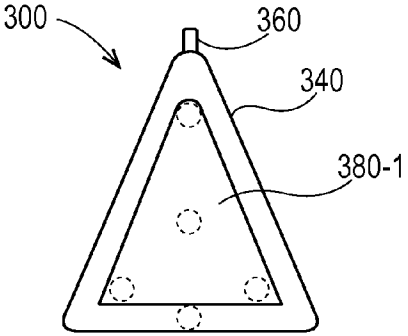
FIG. 3B illustrates a front view of the container of FIG. 3A.
Figure 3C:
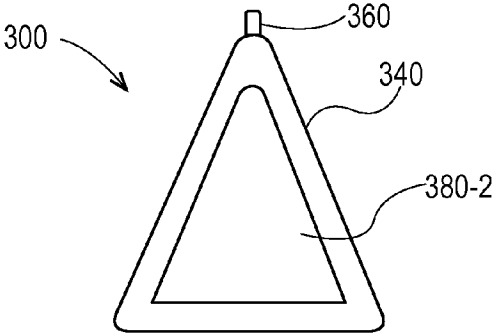
FIG. 3C illustrates a side view of the container of FIG. 3A.
Figure 3D:
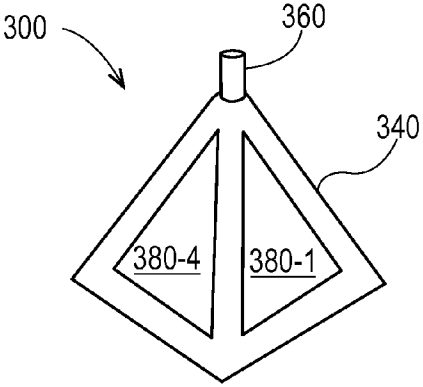
FIG. 3D illustrates an isometric view of the container of FIG. 3A.

FIG. 3A illustrates a front view of a stand up flexible container 300 having a structural support frame 340 that has an overall shape like a pyramid. In the embodiment of FIG. 3A, the pyramid shape is based on a four-sided pyramid, however, in various embodiments, the pyramid shape can be based on a pyramid with a different number of sides. The support frame 340 is formed by structural support members disposed along the edges of the pyramid shape and joined together at their ends. The structural support members define triangular shaped side panels 380-1, 380-2, 380-3, and 380-4, and a square shaped bottom panel (not shown). Each of the side panels 380-1, 380-2, 380-3, and 380-4 is about flat, however in various embodiments, part, parts, or all of any of the side panels can be approximately flat, substantially flat, nearly flat, or completely flat. The container 300 includes a dispenser 360, which is configured to dispense one or more fluent products from one or more product volumes disposed within the container 300. In the embodiment of FIG. 3A, the dispenser 360 is disposed at the apex of the pyramid shape, however, in various alternate embodiments, the dispenser 360 can be disposed anywhere else on the top, sides, or bottom, of the container 300. FIG. 3B illustrates a front view of the container 300 of FIG. 3A, including exemplary additional/alternate locations for a dispenser (shown as phantom lines), any of which can also apply to any side of the container. FIG. 3C illustrates a side view of the container 300 of FIG. 3A. FIG. 3D illustrates an isometric view of the container 300 of FIG. 3A.

Figure 4B:
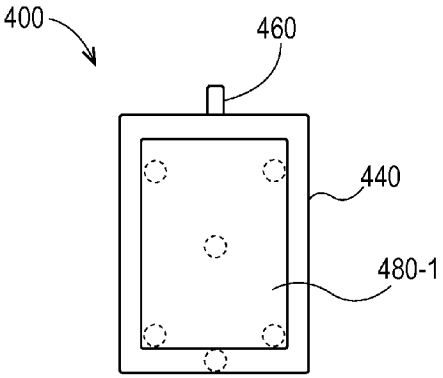
FIG. 4B illustrates a front view of the container of FIG. 4A.
Figure 4A:
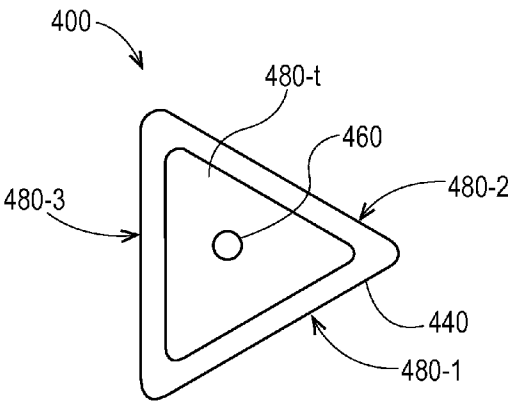
FIG. 4A illustrates a top view of a stand up flexible container having a structural support frame that has an overall shape like a trigonal prism.
Figure 4D:
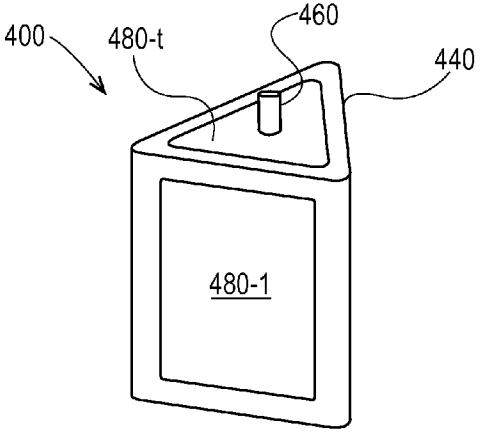
FIG. 4D illustrates an isometric view of the container of FIG. 4A.
Figure 4C:
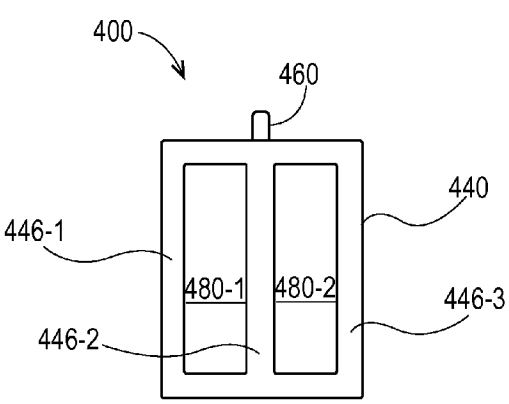
FIG. 4C illustrates a side view of the container of FIG. 4A.

FIG. 4A illustrates a front view of a stand up flexible container 400 having a structural support frame 440 that has an overall shape like a trigonal prism. In the embodiment of FIG. 4A, the prism shape is based on a triangle. The support frame 440 is formed by structural support members disposed along the edges of the prism shape and joined together at their ends. The structural support members define a triangular shaped top panel 480-*t*, rectangular shaped side panels 480-1, 480-2, and 480-3, and a triangular shaped bottom panel (not shown). Each of the side panels 480-1, 480-2, and 480-3 is about flat, however in various embodiments, part, parts, or all of any of the side panels can be approximately flat, substantially flat, nearly flat, or completely flat. The container 400 includes a dispenser 460, which is configured to dispense one or more fluent products from one or more product volumes disposed within the container 400. In the embodiment of FIG. 4A, the dispenser 460 is disposed in the center of the top panel 480-*t*, however, in various alternate embodiments, the dispenser 460 can be disposed anywhere else on the top, sides, or bottom, of the container 400. FIG. 4B illustrates a front view of the container 400 of FIG. 4A, including exemplary additional/alternate locations for a dispenser (shown as phantom lines), any of which can also apply to any side of the container 400. FIG. 4C illustrates a side view of the container 400 of FIG. 4A. FIG. 4D illustrates an isometric view of the container 400 of FIG. 4A.

Figure 5A:
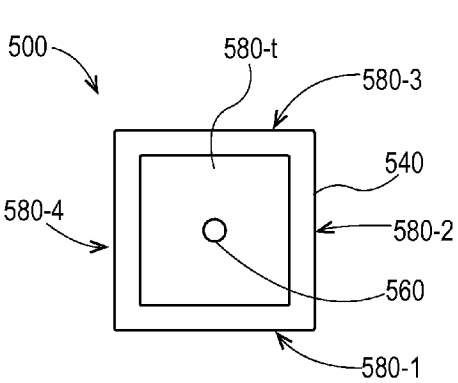
FIG. 5A illustrates a top view of a stand up flexible container having a structural support frame that has an overall shape like a tetragonal prism.
Figure 5B:
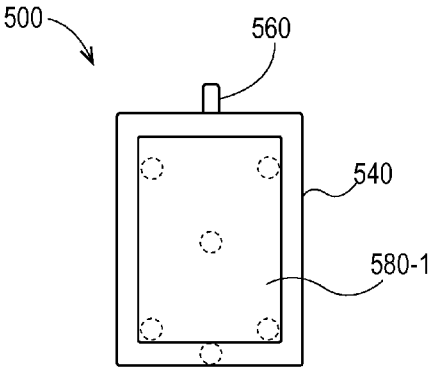
FIG. 5B illustrates a front view of the container of FIG. 5A.
Figure 5C:
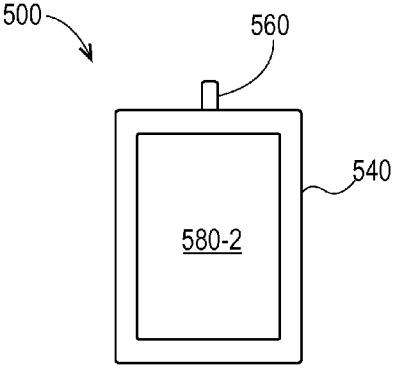
FIG. 5C illustrates a side view of the container of FIG. 5A.
Figure 5D:
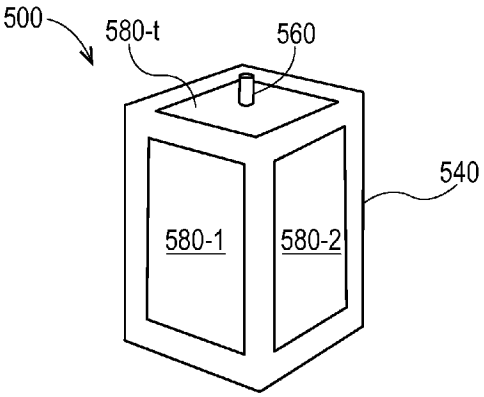
FIG. 5D illustrates an isometric view of the container of FIG. 5A.

FIG. 5A illustrates a front view of a stand up flexible container 500 having a structural support frame 540 that has an overall shape like a tetragonal prism. In the embodiment of FIG. 5A, the prism shape is based on a square. The support frame 540 is formed by structural support members disposed along the edges of the prism shape and joined together at their ends. The structural support members define a square shaped top panel 580-*t*, rectangular shaped side panels 580-1, 580-2, 580-3, and 580-4, and a square shaped bottom panel (not shown). Each of the side panels 580-1, 580-2, 580-3, and 580-4 is about flat, however in various embodiments, part, parts, or all of any of the side panels can be approximately flat, substantially flat, nearly flat, or completely flat. The container 500 includes a dispenser 560, which is configured to dispense one or more fluent products from one or more product volumes disposed within the container 500. In the embodiment of FIG. 5A, the dispenser 560 is disposed in the center of the top panel 580-*t*, however, in various alternate embodiments, the dispenser 560 can be disposed anywhere else on the top, sides, or bottom, of the container 500. FIG. 5B illustrates a front view of the container 500 of FIG. 5A, including exemplary additional/alternate locations for a dispenser (shown as phantom lines), any of which can also apply to any side of the container 500. FIG. 5C illustrates a side view of the container 500 of FIG. 5A. FIG. 5D illustrates an isometric view of the container 500 of FIG. 5A.

Figure 6B:
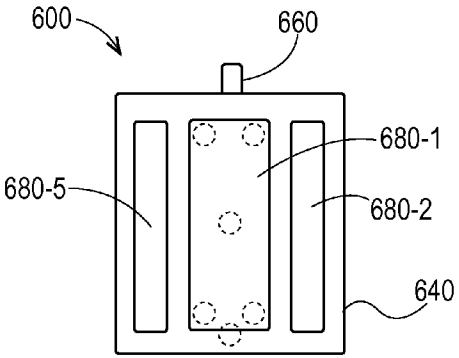
FIG. 6B illustrates a front view of the container of FIG. 6A.
Figure 6D:
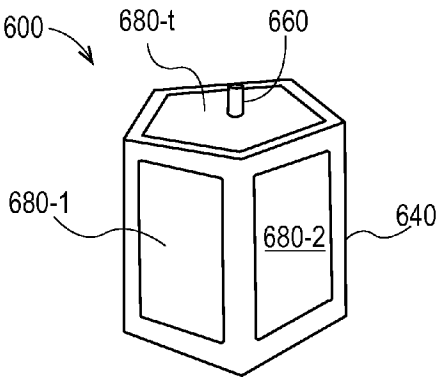
FIG. 6D illustrates an isometric view of the container of FIG. 6A.
Figure 6A:
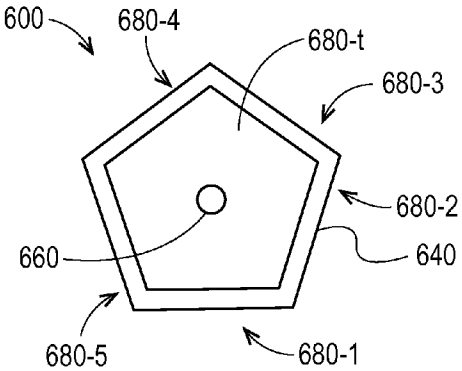
FIG. 6A illustrates a top view of a stand up flexible container having a structural support frame that has an overall shape like a pentagonal prism.
Figure 6C:
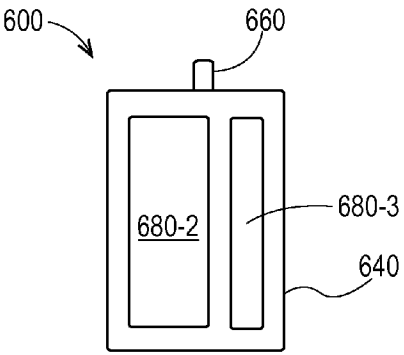
FIG. 6C illustrates a side view of the container of FIG. 6A.

FIG. 6A illustrates a front view of a stand up flexible container 600 having a structural support frame 640 that has an overall shape like a pentagonal prism. In the embodiment of FIG. 6A, the prism shape is based on a pentagon. The support frame 640 is formed by structural support members disposed along the edges of the prism shape and joined together at their ends. The structural support members define a pentagon shaped top panel 680-*t*, rectangular shaped side panels 680-1, 680-2, 680-3, 680-4, and 680-5, and a pentagon shaped bottom panel (not shown). Each of the side panels 680-1, 680-2, 680-3, 680-4, and 680-5 is about flat, however in various embodiments, part, parts, or all of any of the side panels can be approximately flat, substantially flat, nearly flat, or completely flat. The container 600 includes a dispenser 660, which is configured to dispense one or more fluent products from one or more product volumes disposed within the container 600. In the embodiment of FIG. 6A, the dispenser 660 is disposed in the center of the top panel 680-*t*, however, in various alternate embodiments, the dispenser 660 can be disposed anywhere else on the top, sides, or bottom, of the container 600. FIG. 6B illustrates a front view of the container 600 of FIG. 6A, including exemplary additional/alternate locations for a dispenser (shown as phantom lines), any of which can also apply to any side of the container 600. FIG. 6C illustrates a side view of the container 600 of FIG. 6A. FIG. 6D illustrates an isometric view of the container 600 of FIG. 6A.

Figure 7B:
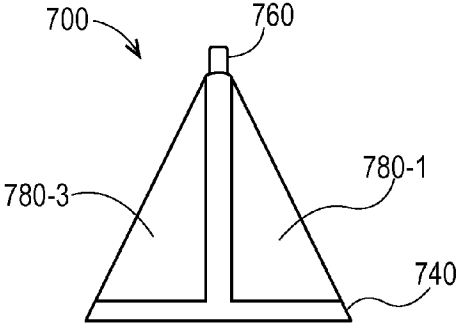
FIG. 7B illustrates a front view of the container of FIG. 7A.
Figure 7D:
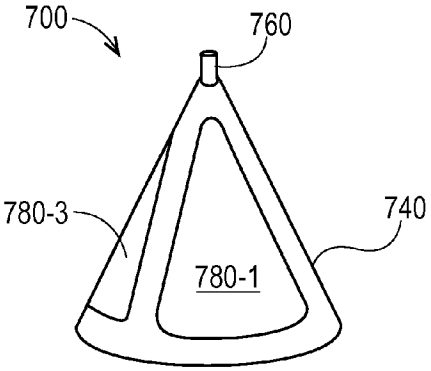
FIG. 7D illustrates an isometric view of the container of FIG. 7A.
Figure 7A:
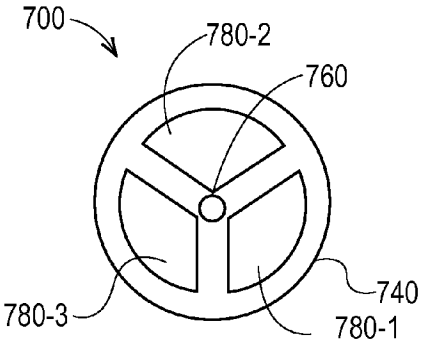
FIG. 7A illustrates a top view of a stand up flexible container having a structural support frame that has an overall shape like a cone.
Figure 7C:
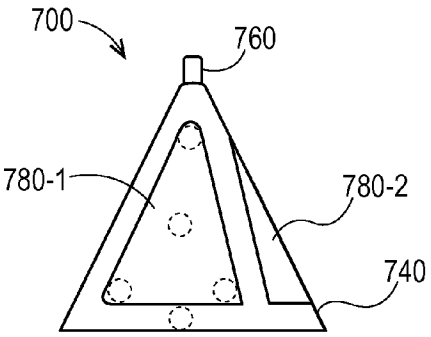
FIG. 7C illustrates a side view of the container of FIG. 7A.

FIG. 7A illustrates a front view of a stand up flexible container 700 having a structural support frame 740 that has an overall shape like a cone. The support frame 740 is formed by curved structural support members disposed around the base of the cone and by straight structural support members extending linearly from the base to the apex, wherein the structural support members are joined together at their ends. The structural support members define curved somewhat triangular shaped side panels 780-1, 780-2, and 780-3, and a circular shaped bottom panel (not shown). Each of the side panels 780-1, 780-2, and 780-3, is curved, however in various embodiments, part, parts, or all of any of the side panels can be approximately flat, substantially flat, nearly flat, or completely flat. The container 700 includes a dispenser 760, which is configured to dispense one or more fluent products from one or more product volumes disposed within the container 700. In the embodiment of FIG. 7A, the dispenser 760 is disposed at the apex of the conical shape, however, in various alternate embodiments, the dispenser 760 can be disposed anywhere else on the top, sides, or bottom, of the container 700. FIG. 7B illustrates a front view of the container 700 of FIG. 7A. FIG. 7C illustrates a side view of the container 700 of FIG. 7A, including exemplary additional/alternate locations for a dispenser (shown as phantom lines), any of which can also apply to any side panel of the container 700. FIG. 7D illustrates an isometric view of the container 700 of FIG. 7A.

Figure 8A:
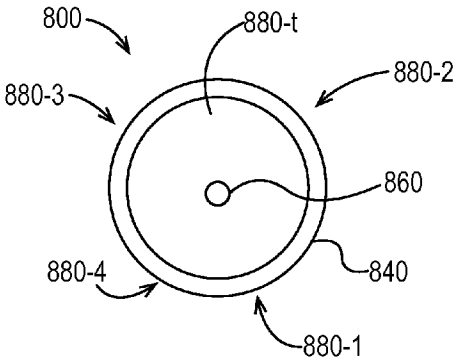
FIG. 8A illustrates a top view of a stand up flexible container having a structural support frame that has an overall shape like a cylinder.
Figure 8B:
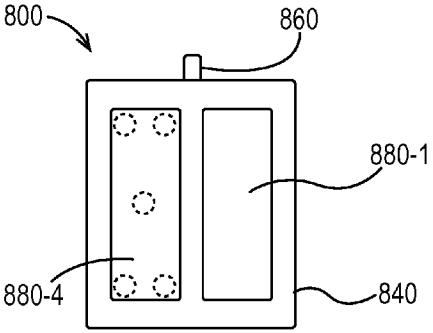
FIG. 8B illustrates a front view of the container of FIG. 8A.
Figure 8C:
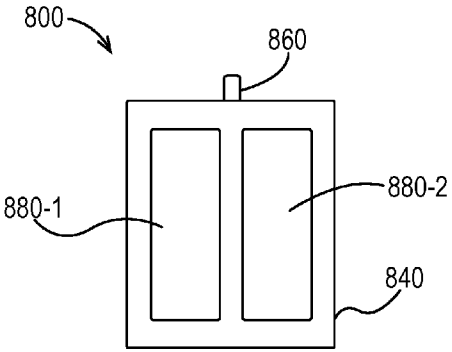
FIG. 8C illustrates a side view of the container of FIG. 8A.
Figure 8D:
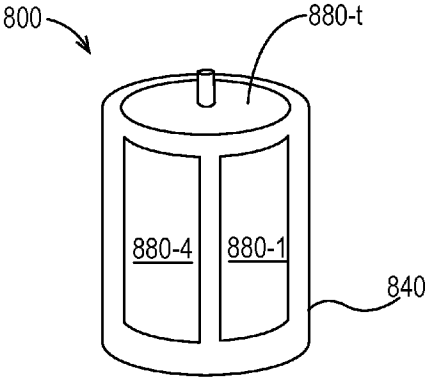
FIG. 8D illustrates an isometric view of the container of FIG. 8A.

FIG. 8A illustrates a front view of a stand up flexible container 800 having a structural support frame 840 that has an overall shape like a cylinder. The support frame 840 is formed by curved structural support members disposed around the top and bottom of the cylinder and by straight structural support members extending linearly from the top to the bottom, wherein the structural support members are joined together at their ends. The structural support members define a circular shaped top panel **880-*t*, curved somewhat rectangular shaped side panels 880-1, 880-2, 880-3, and 880-4, and a circular shaped bottom panel (not shown). Each of the side panels 880-1, 880-2, 880-3, and 880-4, is curved, however in various embodiments, part, parts, or all of any of the side panels can be approximately flat, substantially flat, nearly flat, or completely flat. The container 800 includes a dispenser 860, which is configured to dispense one or more fluent products from one or more product volumes disposed within the container 800. In the embodiment of FIG. 8A, the dispenser 860 is disposed in the center of the top panel 880-*t*, however, in various alternate embodiments, the dispenser 860 can be disposed anywhere else on the top, sides, or bottom, of the container 800. FIG. 8B illustrates a front view of the container 800 of FIG. 8A, including exemplary additional/alternate locations for a dispenser (shown as phantom lines), any of which can also apply to any side panel of the container 800. FIG. 8C illustrates a side view of the container 800 of FIG. 8A. FIG. 8D illustrates an isometric view of the container 800 of FIG. 8**A.

In additional embodiments, any stand up flexible container with a structural support frame, as disclosed herein, can be configured to have an overall shape that corresponds with any other known three-dimensional shape, including any kind of polyhedron, any kind of prismatoid, and any kind of prism (including right prisms and uniform prisms).

Figure 9B:
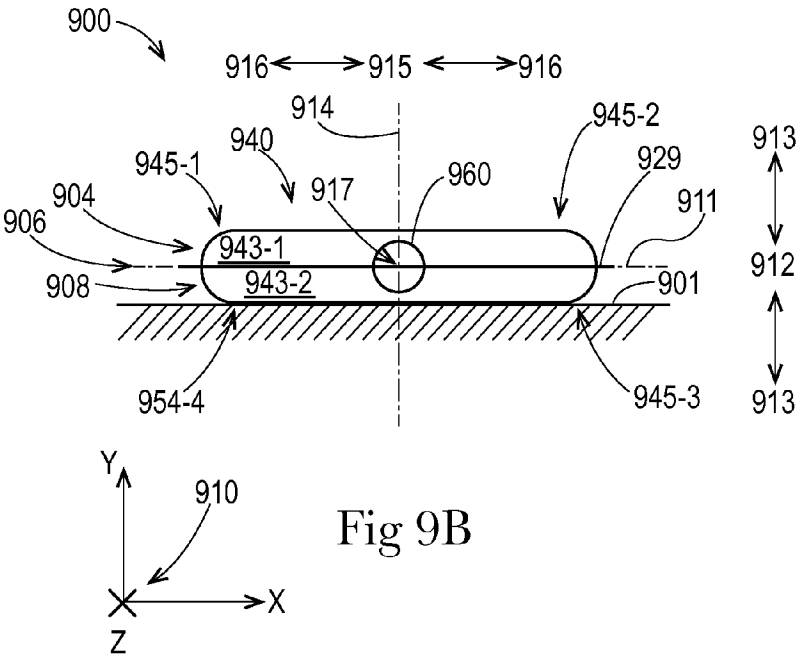
FIG. 9B illustrates an end view of the flexible container of FIG. 9A.
Figure 9A:
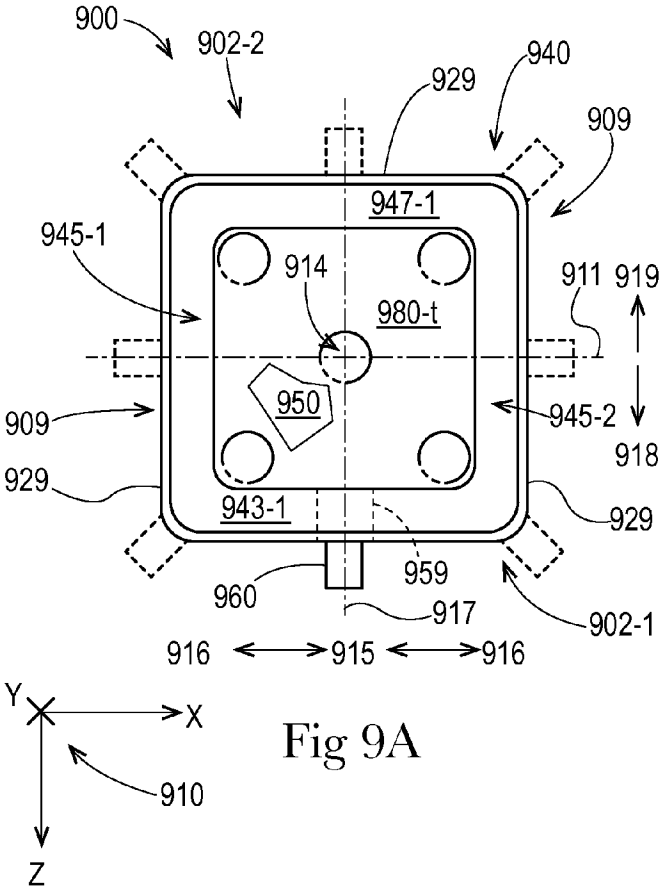
FIG. 9A illustrates a top view of an embodiment of a self-supporting flexible container, having an overall shape like a square.

FIG. 9A illustrates a top view of an embodiment of a self-supporting flexible container 900, having an overall shape like a square. FIG. 9B illustrates an end view of the flexible container 900 of FIG. 9A. The container 900 is resting on a horizontal support surface 901.

In FIG. 9B, a coordinate system 910, provides lines of reference for referring to directions in the figure. The coordinate system 910 is a three-dimensional Cartesian coordinate system, with an X-axis, a Y-axis, and a Z-axis. The X-axis and the Z-axis are parallel with the horizontal support surface 901 and the Y-axis is perpendicular to the horizontal support surface 901.

FIG. 9A also includes other lines of reference, for referring to directions and locations with respect to the container 100. A lateral centerline 911 runs parallel to the X-axis. An XY plane at the lateral centerline 911 separates the container 100 into a front half and a back half. An XZ plane at the lateral centerline 911 separates the container 100 into an upper half and a lower half. A longitudinal centerline 914 runs parallel to the Y-axis. A YZ plane at the longitudinal centerline 914 separates the container 900 into a left half and a right half. A third centerline 917 runs parallel to the Z-axis. The lateral centerline 911, the longitudinal centerline 914, and the third centerline 917 all intersect at a center of the container 900. These terms for direction, orientation, measurement, and disposition, in the embodiment of FIGS. 9A-9B are the same as the like-numbered terms in the embodiment of FIGS. 1A-1D.

The container 900 includes a top 904, a middle 906, and a bottom 908, the front 902-1, the back 902-2, and left and right sides 909. In the embodiment of FIGS. 9A-9B, the upper half and the lower half of the container are joined together at a seal 929, which extends around the outer periphery of the container 900.

The container 900 includes a structural support frame 940, a product volume 950, a dispenser 960, a top panel **980-*t* and a bottom panel (not shown). A portion of the top panel 980-*t* is illustrated as broken away, in order to show the product volume 950. The product volume 950 is configured to contain one or more fluent products. The dispenser 960 allows the container 900 to dispense these fluent product(s) from the product volume 950 through a flow channel 959 then through the dispenser 960, to the environment outside of the container 900. The structural support frame 940 supports the mass of fluent product(s) in the product volume 950. The top panel 980-*t* and the bottom panel are relatively flat surfaces, overlaying the product volume 950**, and are suitable for displaying any kind of indicia.

The structural support frame 940 is formed by a plurality of structural support members. The structural support frame 940 includes front structural support members 943-1 and 943-2, intermediate structural support members 945-1, 945-2, 945-3, and 945-4, as well as back structural support members 947-1 and 947-2. Overall, each of the structural support members in the container 900 is oriented horizontally. And, each of the structural support members in the container 900 has a cross-sectional area that is substantially uniform along its length, although in various embodiments, this cross-sectional area can vary.

Upper structural support members 943-1, 945-1, 945-2, and 947-1 are disposed in an upper part of the middle 906 and in the top 904, while lower structural support members 943-2, 945-4, 945-3, and 947-2 are disposed in a lower part of the middle 906 and in the bottom 908. The upper structural support members 943-1, 945-1, 945-2, and 947-1 are disposed above and adjacent to the lower structural support members 943-2, 945-4, 945-3, and 947-2, respectively.

In various embodiments, adjacent upper and lower structural support members can be in contact with each other at one or more relatively smaller locations and/or at one or more relatively larger locations, along part, or parts, or about all, or approximately all, or substantially all, or nearly all of their overall lengths, so long as there is a gap in the contact for the flow channel 959, between the structural support members 943-1 and 943-2. In the embodiment of FIGS. 9A-9B, the upper and lower structural support members are not directly connected to each other. However, in various alternate embodiments, adjacent upper and lower structural support members can be directly connected and/or joined together along part, or parts, or about all, or approximately all, or substantially all, or nearly all, or all of their overall lengths.

The ends of structural support members 943-1, 945-2, 947-1, and 945-1 are joined together to form a top square that is outward from and surrounding the product volume 950, and the ends of structural support members 943-2, 945-3, 947-2, and 945-4 are also joined together to form a bottom square that is outward from and surrounding the product volume 950. In the structural support frame 940, the ends of the structural support members, which are joined together, are directly connected, all around the periphery of their walls. However, in various alternative embodiments, any of the structural support members of the embodiment of FIGS. 9A-9B can be joined together in any way described herein or known in the art.

In alternative embodiments of the structural support frame 940, adjacent structural support members can be combined into a single structural support member, wherein the combined structural support member can effectively substitute for the adjacent structural support members, as their functions and connections are described herein. In other alternative embodiments of the structural support frame 940, one or more additional structural support members can be added to the structural support members in the structural support frame 940, wherein the expanded structural support frame can effectively substitute for the structural support frame 940, as its functions and connections are described herein.

FIGS. 10A-11B illustrate embodiments of self-supporting flexible containers (that are not stand up containers) having various overall shapes. Any of the embodiments of FIGS. 10A-11B can be configured according to any of the embodiments disclosed herein, including the embodiments of FIGS. 9A-9B. Any of the elements (e.g. structural support frames, structural support members, panels, dispensers, etc.) of the embodiments of FIGS. 10A-11B, can be configured according to any of the embodiments disclosed herein. While each of the embodiments of FIGS. 10A-11B illustrates a container with one dispenser, in various embodiments, each container can include multiple dispensers, according to any embodiment described herein. Part, parts, or all of each of the panels in the embodiments of FIGS. 10A-11B is suitable to display any kind of indicia. Each of the top and bottom panels in the embodiments of FIGS. 10A-11B is configured to be a nonstructural panel, overlaying product volume(s) disposed within the flexible container, however, in various embodiments, one or more of any kind of decorative or structural element (such as a rib, protruding from an outer surface) can be joined to part, parts, or all of any of these panels. For clarity, not all structural details of these flexible containers are shown in FIGS. 10A-11B, however any of the embodiments of FIGS. 10A-11B can be configured to include any structure or feature for flexible containers, disclosed herein.

Figure 10B:
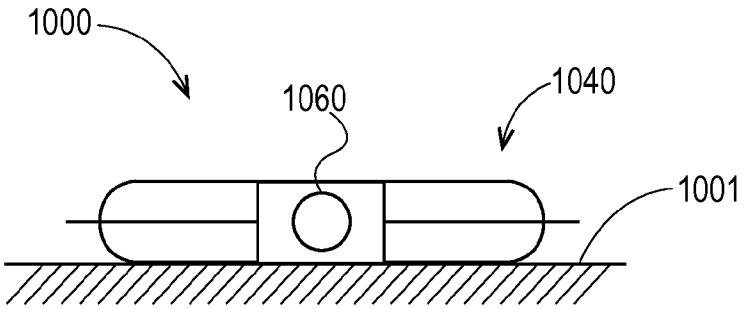
FIG. 10B illustrates an end view of the flexible container of FIG. 10A.
Figure 10A:
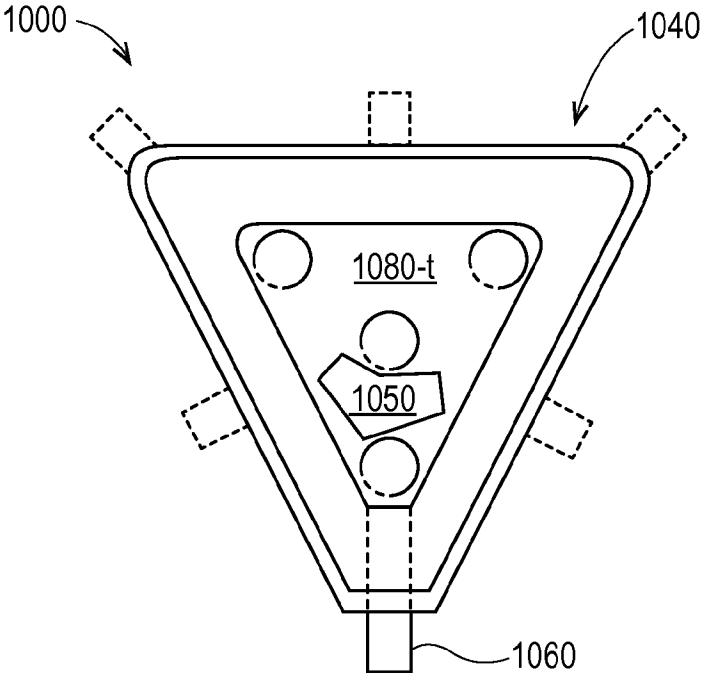
FIG. 10A illustrates a top view of an embodiment of a self-supporting flexible container, having an overall shape like a triangle.

FIG. 10A illustrates a top view of an embodiment of a self-supporting flexible container 1000 (that is not a stand-up flexible container) having an overall shape like a triangle. However, in various embodiments, a self-supporting flexible container can have an overall shape like a polygon having any number of sides. The support frame 1040 is formed by structural support members disposed along the edges of the triangular shape and joined together at their ends. The structural support members define a triangular shaped top panel 1080-*t*, and a triangular shaped bottom panel (not shown). The top panel 1080-*t* and the bottom panel are about flat, however in various embodiments, part, parts, or all of any of the side panels can be approximately flat, substantially flat, nearly flat, or completely flat. The container 1000 includes a dispenser 1060, which is configured to dispense one or more fluent products from one or more product volumes disposed within the container 1000. In the embodiment of FIG. 10A, the dispenser 1060 is disposed in the center of the front, however, in various alternate embodiments, the dispenser 1060 can be disposed anywhere else on the top, sides, or bottom, of the container 1000. FIG. 10A includes exemplary additional/alternate locations for a dispenser (shown as phantom lines). FIG. 10B illustrates an end view of the flexible container 1000 of FIG. 10B, resting on a horizontal support surface 1001.

Figure 11B:
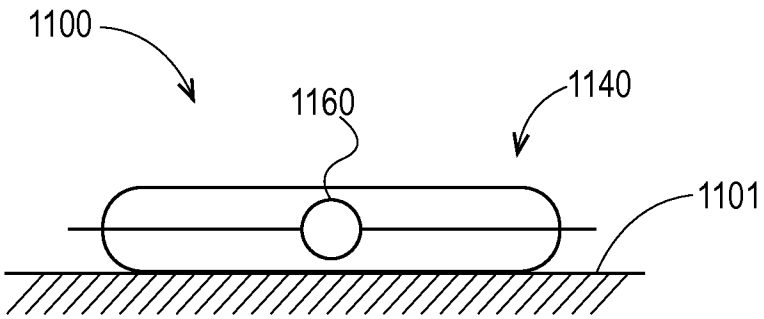
FIG. 11B illustrates an end view of the flexible container of FIG. 11A.
Figure 11A:
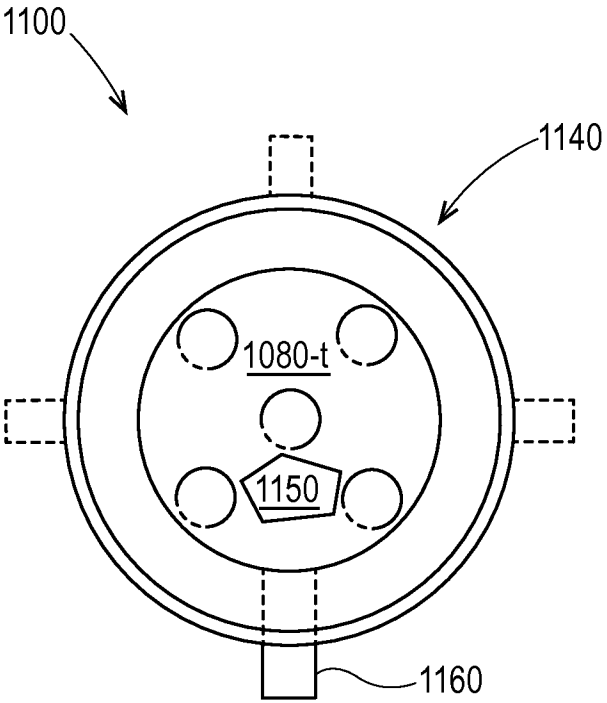
FIG. 11A illustrates a top view of an embodiment of a self-supporting flexible container, having an overall shape like a circle.

FIG. 11A illustrates a top view of an embodiment of a self-supporting flexible container 1100 (that is not a stand-up flexible container) having an overall shape like a circle. The support frame 1140 is formed by structural support members disposed around the circumference of the circular shape and joined together at their ends. The structural support members define a circular shaped top panel 1180-*t*, and a circular shaped bottom panel (not shown). The top panel 1180-*t* and the bottom panel are about flat, however in various embodiments, part, parts, or all of any of the side panels can be approximately flat, substantially flat, nearly flat, or completely flat. The container 1100 includes a dispenser 1160, which is configured to dispense one or more fluent products from one or more product volumes disposed within the container 1100. In the embodiment of FIG. 11A, the dispenser 1160 is disposed in the center of the front, however, in various alternate embodiments, the dispenser 1160 can be disposed anywhere else on the top, sides, or bottom, of the container 1100. FIG. 11A includes exemplary additional/alternate locations for a dispenser (shown as phantom lines). FIG. 11B illustrates an end view of the flexible container 1100 of FIG. 10B, resting on a horizontal support surface 1101.

In additional embodiments, any self-supporting container with a structural support frame, as disclosed herein, can be configured to have an overall shape that corresponds with any other known three-dimensional shape. For example, any self-supporting container with a structural support frame, as disclosed herein, can be configured to have an overall shape (when observed from a top view) that corresponds with a rectangle, a polygon (having any number of sides), an oval, an ellipse, a star, or any other shape, or combinations of any of these.

Figure 12A:
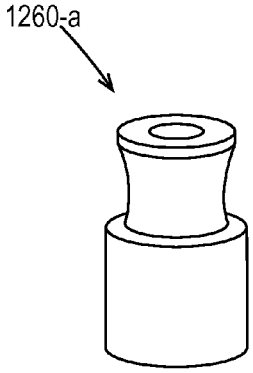
FIG. 12A illustrates an isometric view of push-pull type dispenser.
Figure 12B:
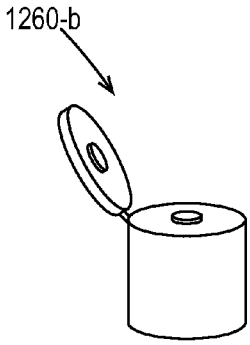
FIG. 12B illustrates an isometric view of dispenser with a flip-top cap.
Figure 12C:
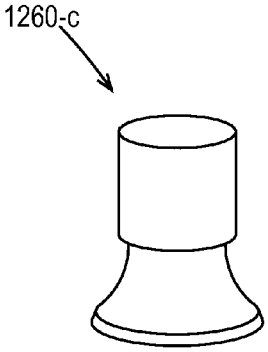
FIG. 12C illustrates an isometric view of dispenser with a screw-on cap.
Figure 12D:
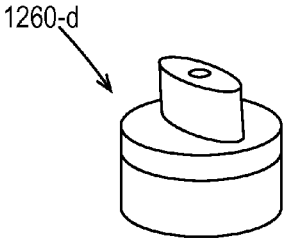
FIG. 12D illustrates an isometric view of rotatable type dispenser.
Figure 12E:
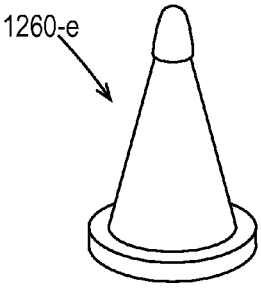
FIG. 12E illustrates an isometric view of nozzle type dispenser with a cap.
Figures 13A, 13B, 13C, 13D:
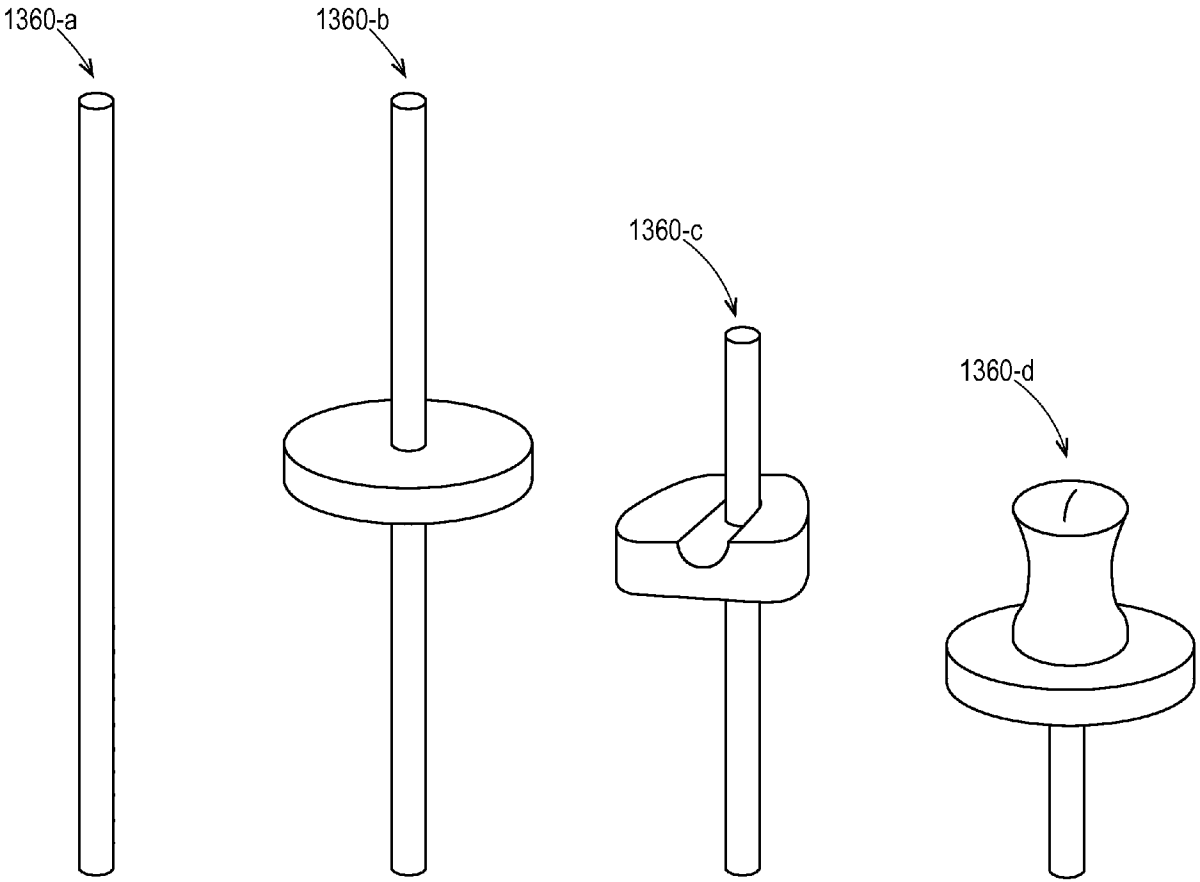
FIG. 13A illustrates an isometric view of straw dispenser.
FIG. 13B illustrates an isometric view of straw dispenser with a lid.
FIG. 13C illustrates an isometric view of flip up straw dispenser.
FIG. 13D illustrates an isometric view of straw dispenser with bite valve.
Figure 14C:
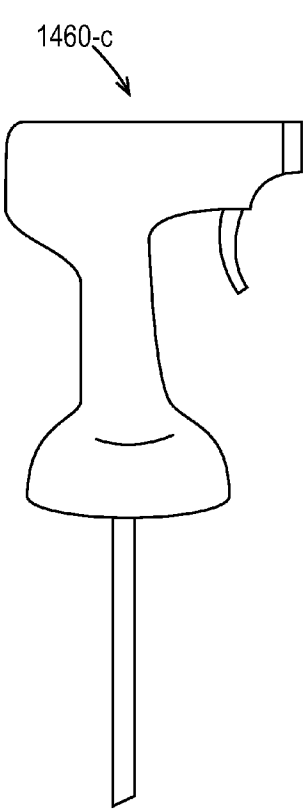
FIG. 14C illustrates an isometric view of trigger spray type dispenser.
Figure 14B:
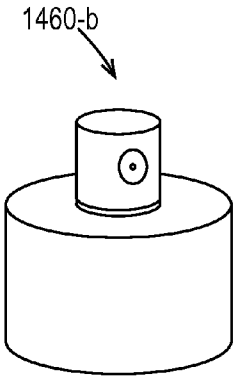
FIG. 14B illustrates an isometric view of pump spray type dispenser.
Figure 14A:
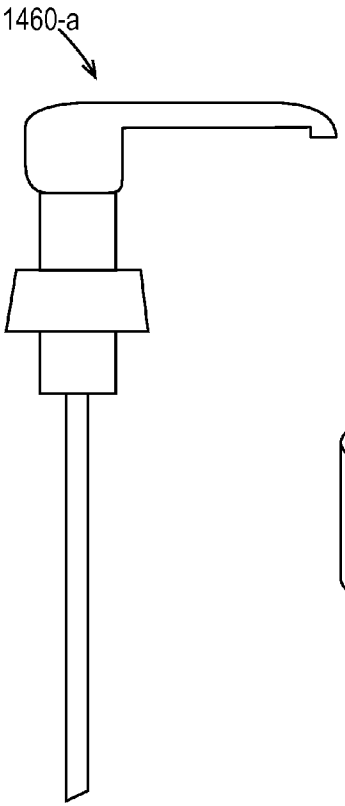
FIG. 14A illustrates an isometric view of pump type dispenser.

FIGS. 12A-14C illustrate various exemplary dispensers, which can be used with the flexible containers disclosed herein. FIG. 12A illustrates an isometric view of push-pull type dispenser 1260-*a*. FIG. 12B illustrates an isometric view of dispenser with a flip-top cap 1260-*b*. FIG. 12C illustrates an isometric view of dispenser with a screw-on cap 1260-*c*. FIG. 12D illustrates an isometric view of rotatable type dispenser 1260-*d*. FIG. 12E illustrates an isometric view of nozzle type dispenser with a cap 1260-*d*. FIG. 13A illustrates an isometric view of straw dispenser 1360-*a*. FIG. 13B illustrates an isometric view of straw dispenser with a lid 1360-*b*. FIG. 13C illustrates an isometric view of flip up straw dispenser 1360-*c*. FIG. 13D illustrates an isometric view of straw dispenser with bite valve 1360-*d*. FIG. 14A illustrates an isometric view of pump type dispenser 1460-*a*. FIG. 14B illustrates an isometric view of pump spray type dispenser 1460-*b*. FIG. 14C illustrates an isometric view of trigger spray type dispenser 1460-*c*.

Figure 15:
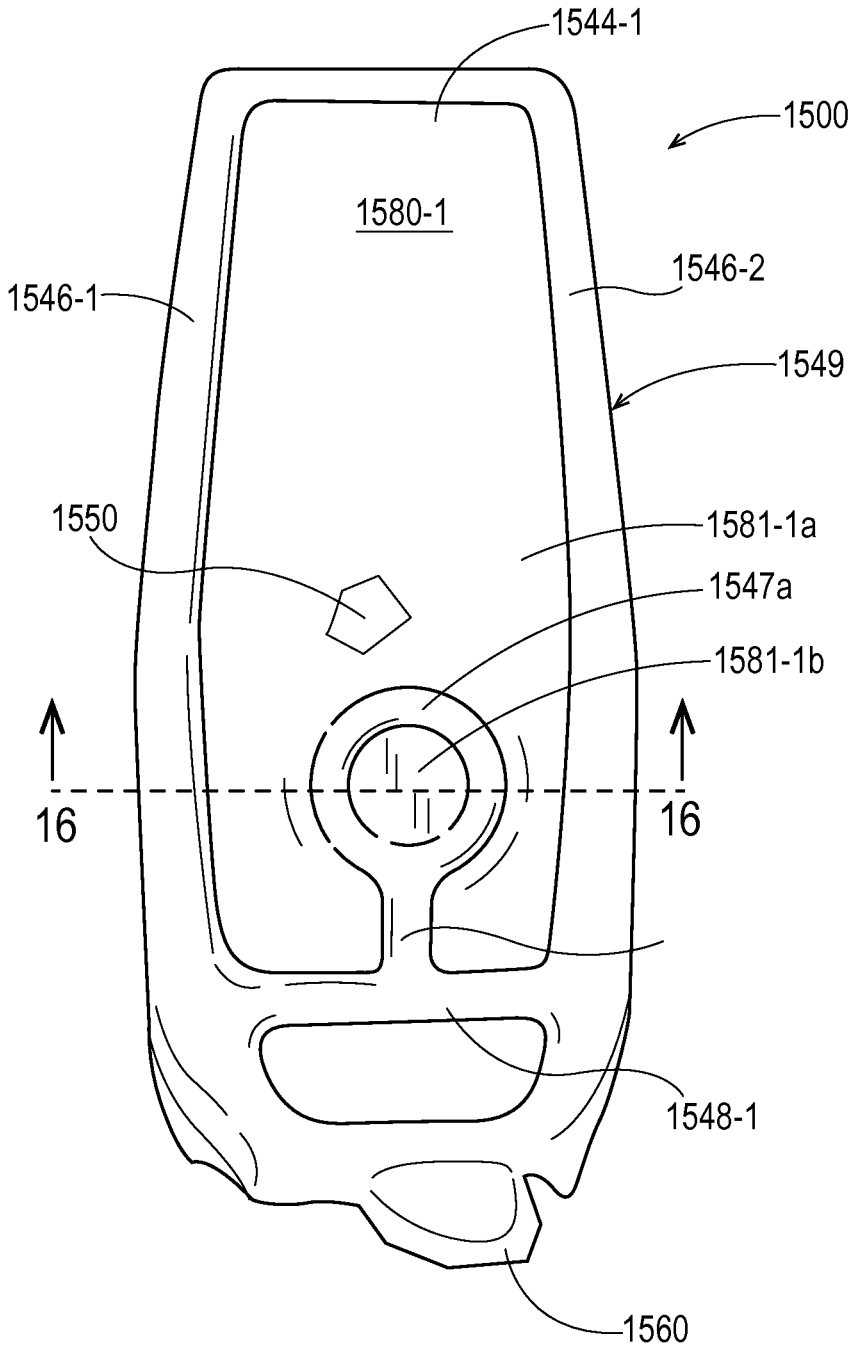
FIG. 15 illustrates a front view of an embodiment of disposable flexible container having one form of surface elements.

Referring to FIG. 15, a disposable flexible container 1500 comprises a product volume 1550 for a fluent product at least partially defined by a nonstructural panel 1580-1 having one or more flat spaces such as 1581-1*a* and 1581-1*b* and one or more structural support volumes such as 1544-1, 1546-1, 1546-2 and 1548-1. The disposable flexible container 1500 also includes one or more surface elements such as 1547*a* projecting outwardly in relation to the one or more flat spaces such as 1581-1*a* and 1581-1*b* on the nonstructural panel 1580-1. Preferably, the one or more structural support volumes such as 1544-1, 1546-1, 1546-2 and 1548-1 comprise a structural support frame generally designated 1549 configured to prevent the container 1500 from collapsing and arranged to generate and maintain tension in the nonstructural panel 1580-1 when expanded.

In order to understand the manner in which tension can be generated and maintained in a nonstructural panel such as 1580-1, it is instructive to refer to FIGS. 17A-17F which illustrate the principle behind utilizing structural support volumes.

Figure 17C:
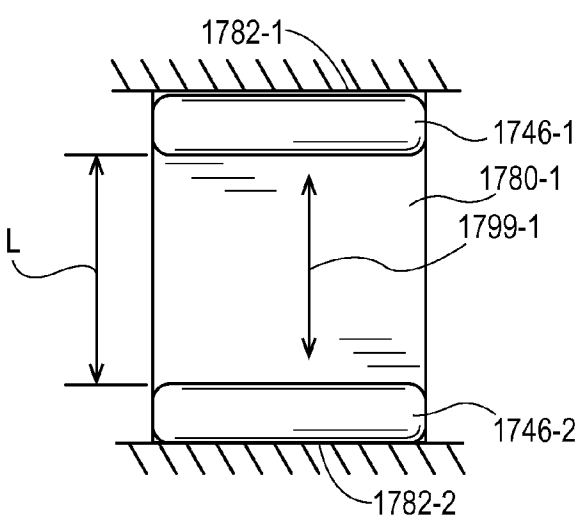
FIG. 17C illustrates a nonstructural panel having opposed fixed sides and having a structural support volume associated with both of the fixed sides.
Figure 17B:
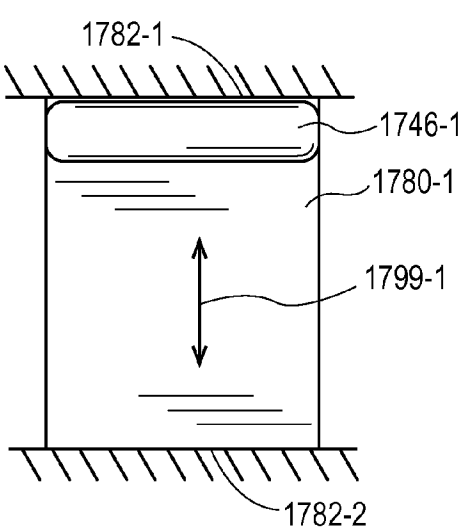
FIG. 17B illustrates a nonstructural panel having opposed fixed sides and having a structural support volume associated with one of the fixed sides.
Figure 17A:
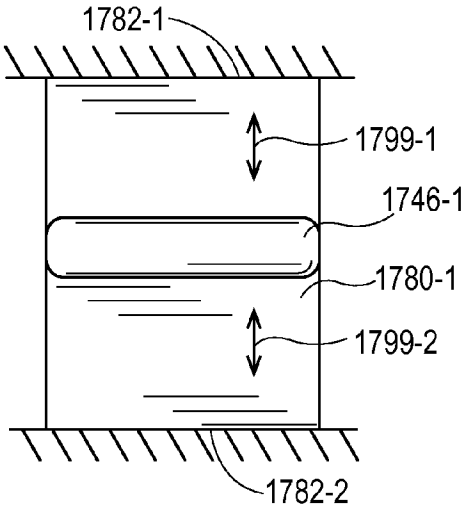
FIG. 17A illustrates a nonstructural panel having opposed fixed sides and having a structural support volume disposed intermediate the fixed sides.

Referring to FIG. 17A, a nonstructural panel 1780-1 has opposed fixed sides 1782-1, 1782-2 and the structural support volume 1746-1 is disposed at a point intermediate the fixed sides 1782-1, 1782-2 of the nonstructural panel 1780-1. When the structural support volume 1746-1 is expanded, e.g., by inflation, tension is generated and maintained in the nonstructural panel 1780-1 represented by the arrows 1799-1 and 1799-2 on either side of the structural support volume 1746-1.

Referring next to FIG. 17B, the nonstructural panel 1780-1 has opposed fixed sides 1782-1, 1782-2 and the structural support volume 1746-1 is associated with one of the fixed sides, i.e., fixed side 1782-1, of the nonstructural panel 1780-1. When the structural support volume 1746-1 is expanded, tension is generated and maintained in the nonstructural panel 1780-1 represented by the arrow 1799-1 on the panel side of the structural support volume 1746-1.

Referring to FIG. 17C, the nonstructural panel 1780-1 has opposed fixed sides 1782-1, 1782-2 and one of the structural support volumes 1746-1, 1746-2 is associated with each of the fixed sides 1782-1, 1782-1 of the nonstructural panel 1780-1. When the structural support volumes 1746-1, 1746-2 are expanded, tension is generated and maintained in the nonstructural panel 1780-1 as represented by the arrow 1799-1 between the structural support volumes 1746-1, 1746-2. The two structural support volumes are at a separation distance of L from each other as indicated.

In the embodiment of FIG. 17C, it will be appreciated that the nonstructural panel 1780-1 has a perimeter and the one or more structural support volumes i.e., the structural support volumes 1746-1, 1746-2, surround about 50% of the perimeter of the nonstructural panel 1780-1.

Figure 17D:
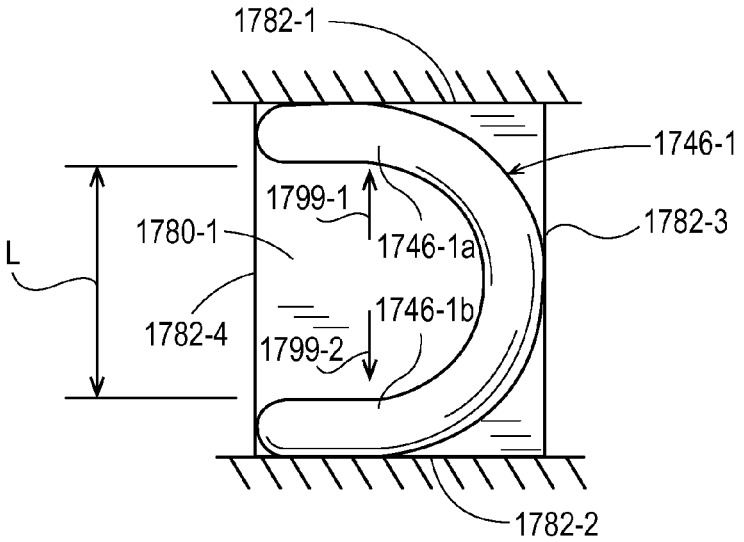
FIG. 17D illustrates a nonstructural panel having opposed fixed sides and having a structural support volume surrounding at least 50% of the perimeter of the nonstructural panel.

Referring next to FIG. 17D, the nonstructural panel 1780-1 includes a perimeter which, as illustrated, has opposed fixed sides 1782-1, 1782-2 and the structural support volume 1746-1 surrounds more than 50% of the nonstructural panel 1780-1 in association with, or proximity to, the perimeter of the nonstructural panel 1780-1. More specifically, and still referring to FIG. 17D, the nonstructural panel 1780-1 includes first and second pairs of opposed sides and, in particular, opposed fixed sides 1782-1, 1782-2 as well as opposed sides 1782-3, 1782-4 extending between opposed fixed sides 1782-1, 1782-2. In the illustrated embodiment, the structural support volume 1746-1 surrounds the nonstructural panel 1780-1 in association with, or proximity to, the first pair of opposed fixed sides 1782-1, 1782-2 and at least one of the second pair of opposed sides 1782-3.

When the structural support volume 1746-1 is expanded, tension is generated and maintained in the nonstructural panel 1780-1 as represented by the arrows 1799-1, 1799-2 between the structural support volume portions 1746-1*a*, 1741-1*b*. Thus, in the embodiment of FIG. 17D, the nonstructural panel 1780-1 has a perimeter and the one or more structural support volumes i.e., the structural support volume 1746-1, surrounds about 75% of the perimeter of the nonstructural panel 1780-1.

Figure 17E:
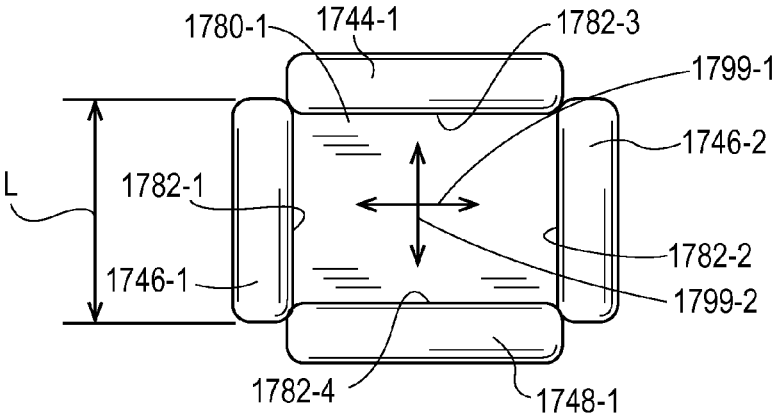
FIG. 17E illustrates a nonstructural panel having two pairs of opposed sides and having multiple structural support volumes surrounding the nonstructural panel.
Figure 17F:
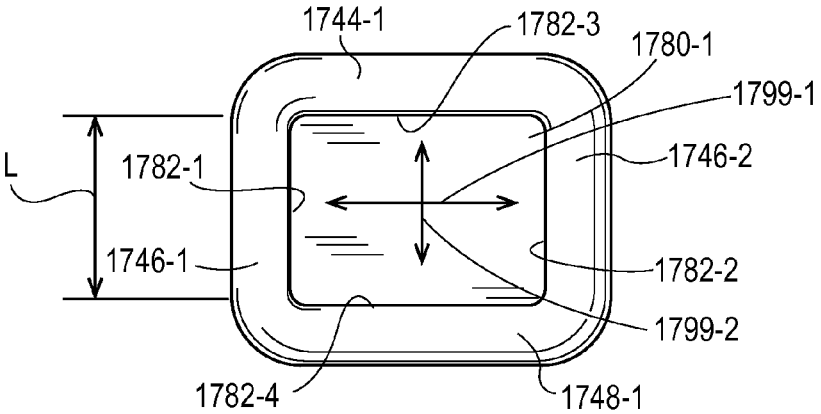
FIG. 17F illustrates a nonstructural panel having two pairs of opposed sides and having a structural support volume surrounding the nonstructural panel.

However, in still other embodiments, the nonstructural panel 1780-1 has a perimeter wherein the one or more structural support volumes surround about 100% of the perimeter of the nonstructural panel 1780-1 (see, e.g., FIGS. 17E and 17F).

Referring to FIG. 17E, the nonstructural panel 1780-1 includes first and second pairs of opposed sides and, in particular, opposed sides 1782-1, 1782-2 as well as opposed sides 1782-3, 1782-4 extending between opposed sides 1782-1, 1782-2 and, in the illustrated embodiment, the structural support volumes 1746-1, 1746-2 and 1744-1, 1748-1 surround the nonstructural panel 1780-1 in association with, or proximity to, the first and second pairs of opposed sides 1782-1, 1782-2, and 1782-3, 1782-4, respectively. In this embodiment, the structural support volumes 1746-1, 1746-2 and 1744-1, 1748-1 comprise a first pair of opposed structural support volumes (1746-1, 1746-2) in proximity to the first pair of opposed sides 1782-1, 1782-2 to impart tension to the nonstructural panel 1780-1 and a second pair of opposed structural support volumes (1744-1, 1748-1) in proximity to the second pair of opposed sides 1782-3, 1782-4 to maintain the first pair of opposed structural support volumes (1746-1, 1746-2) a distance apart. Thus, when all of the structural support volumes 1746-1, 1746-2, and 1744-1, 1748-1 are expanded, the structural support volumes 1744-1, 1748-1 maintain the opposed structural support volumes 1746-1, 1746-2 in spaced apart relation at a distance from one another, and the corresponding structural support volumes 1746-1, 1746-2 and 1744-1, 1748-1 cause tension to be generated and maintained in the nonstructural panel 1780-1 in perpendicular directions as represented by the arrows 1799-1 and 1799-2, respectively, in FIG. 17E.

Referring to FIG. 17F, the nonstructural panel 1780-1 includes first and second pairs of opposed sides and, in particular, opposed sides 1782-1, 1782-2 as well as opposed sides 1782-3, 1782-4 extending between opposed sides 1782-1, 1782-2 and, in the illustrated embodiment, the single continuous structural support volume substantially entirely surrounds the nonstructural panel 1780-1 in association with, or proximity to, the first and second pairs of opposed sides 1782-1, 1782-2, 1782-3, 1782-4. Thus, in this embodiment, the structural support volume comprises a single continuous structural support volume substantially entirely surrounding the nonstructural panel 1780-1 to impart tension through both of the first and second pairs of opposed sides 1782-1, 1782-2, 1782-3, 1782-4. When the structural support volume is expanded e.g., by inflation, it maintains structural support volume portions 1746-1, 1746-2, 1744-1, 1748-1 in spaced apart relation at a distance from one another thereby causing tension to be generated and maintained in the nonstructural panel 1780-1 as represented by the arrows 1799-1, 1799-2.

In the embodiments of FIGS. 17E and 17F, it will be appreciated that the structural support volumes or volume portions 1746-1, 1746-2, 1744-1, 1748-1 correspond generally to the structural support volumes 146-1, 146-2, 144-1, 148-1 in FIGS. 1A-1D.

In a practical embodiment of a disposable flexible container in accordance with the disclosure, the disposable flexible container 1500 of FIG. 15 is substantially similar to the disposable flexible container 100 of FIG. 1A. However, this embodiment has one or more surface elements such as 1547*a* projecting outwardly in relation to the one or more flat spaces such as 1581-1*a* and 1581-1*b* on the nonstructural panel 1580-1. In other respects, the disposable flexible containers 100 and 1500 may be identical, or may differ, e.g., by having the dispenser 1560 at the bottom of the container 1500 unlike the dispenser 160 which is at the top of the container 100.

Referring specifically to FIG. 15, the nonstructural panel 1580-1 may suitably comprise a squeeze panel formed of a flexible material wherein the product volume 1550 is at least partially between the squeeze panel 1580-1 and another panel such as 180-2 in FIGS. 1B and 1C also formed of a flexible material that may be the same as or different from the flexible material of the squeeze panel. The one or more surface elements such as 1547*a* may suitably comprise at least one nonstructural volume (see, also, FIG. 16) to define a flat space comprising a finger rest as at 1581-1*b* on the squeeze panel 1580-1. In particular, a finger rest is to be understood as referring to a configuration comprising an area defined by one or more recesses and/or one or more protrusions that serve to i) locate, ii) constrain movement of, and/or iii) aid in gripping by any one or more of the digits on the human hand In the embodiment of FIG. 16, the finger rest 1581-1*b* defined by the at least one nonstructural volume is generally circular in shape, and a nonstructural volume 1547*b* extends between the nonstructural volume 1547*a* and the structural support volume 1548-1 to facilitate fluid communication between the two of them. However, it will be understood that a finger rest in accordance with the disclosure can take any of a wide variety of different configurations that provide a designated area or areas on a nonstructural panel for one or more of the digits on the human hand including the first finger, middle finger, ring finger, pinky finger or thumb.

Figure 18:
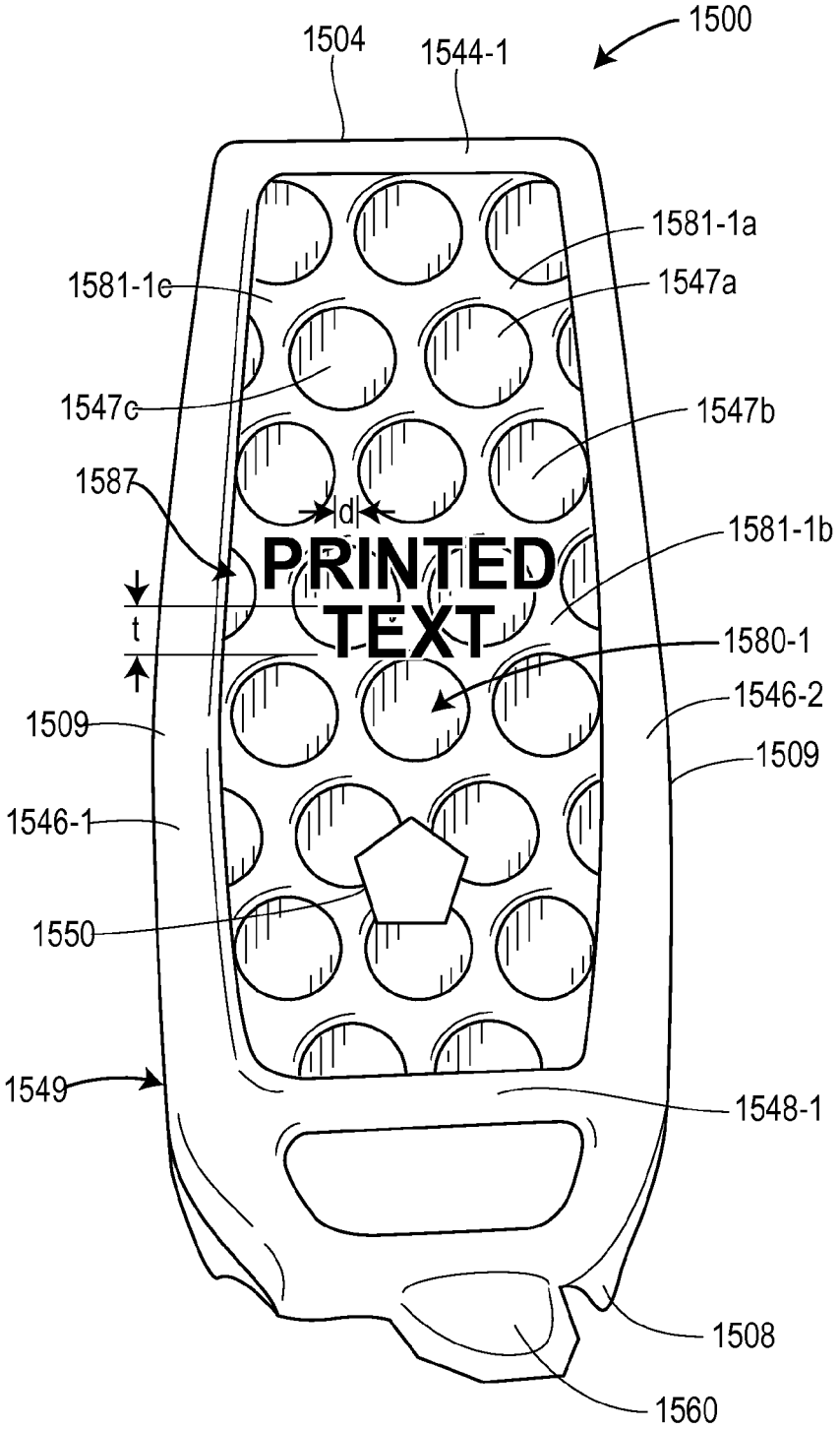
FIG. 18 illustrates a front view of another embodiment of disposable flexible container having another form of surface elements.

Referring to FIG. 18, the one or more surface elements 1547*a*, 1547*b*, 1547*c*, etc. may suitably comprise a pattern of nonstructural volumes which project outwardly of the one or more flat spaces 1581-1*a*, 1581,1*b*, 1581-1*c*, etc. on the squeeze panel 1580-1 and, while shown in FIG. 18 as a regular pattern, it will be understood and appreciated that the pattern of nonstructural volumes on the squeeze panel 1580-1 may comprise any desired regular or irregular pattern wherein the nonstructural volumes have any desired shape(s) and/or size(s).

Figure 19:
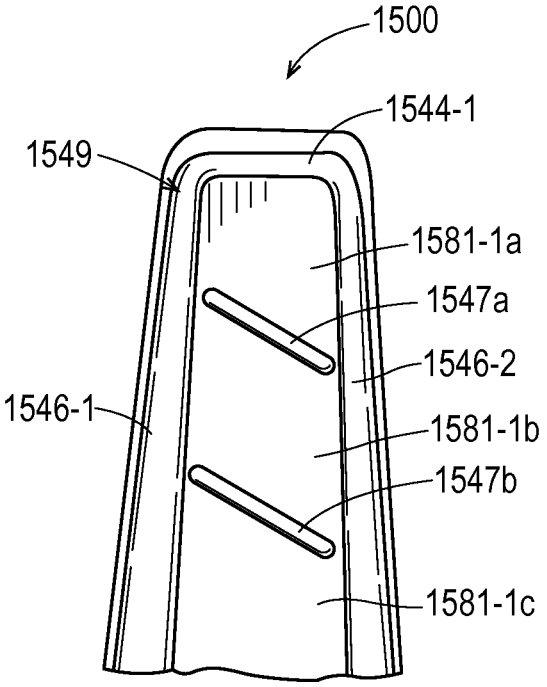
FIG. 19 illustrates a front view of another embodiment of disposable flexible container having another form of surface elements.

Referring to FIG. 19, the one or more surface elements 1547*a*, 1547*b*, etc. may suitably comprise a plurality of nonstructural volumes which serve to divide the squeeze panel 1580-1 into multiple nonstructural subpanels or flat spaces 1581-1*a*, 1581-1*b*, 1581-1*c*, etc. and, while shown in FIG. 19 as linear angled nonstructural volumes, it will be understood that the surface elements such as 1547*a*, 1547*b*, etc. may have any desired shape(s) and/or arrangement(s) and/or size(s).

Figure 16:
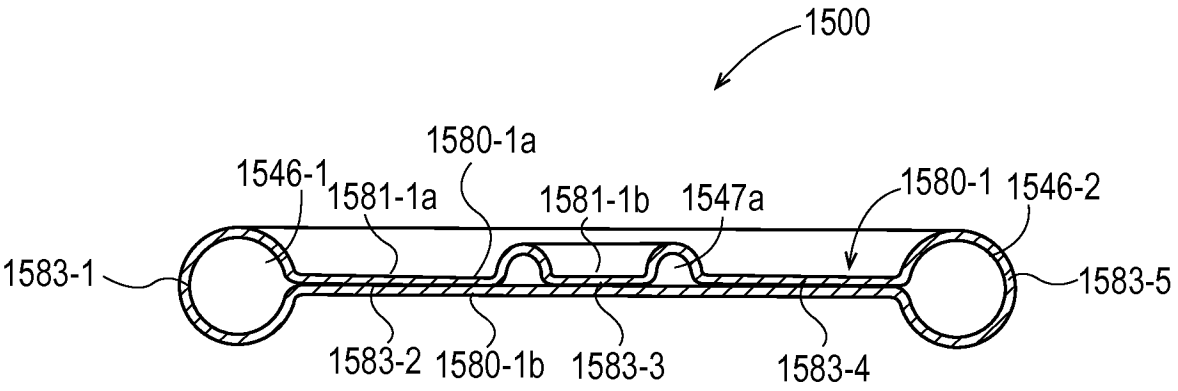
FIG. 16 is a cross-sectional view taken generally along the line 16-16 through the front panel of the container of FIG. 15.

Referring to FIG. 16, the nonstructural panel 1580-1 may comprise first and second layers 1580-1*a*, 1580-1*b* defining a double wall wherein one or more heat seals join the first and second layers at discrete locations such as 1583-1, 1583-2, 1583-3, 1583-4, 1583-5. While heat seals may be used, it will also be understood that the first and second layers defining the double wall can be joined or bonded where needed by any other known manner of joining two flexible materials together. The heat seals form at least one or more structural support volumes such as 1546-1 and 1546-2 as well as one or more nonstructural volumes such as 1547*a* comprising the one or more surface elements of the container 1500 between the first and second layers 1580-1*a*, 1580-1*b*.

With regard to the one or more nonstructural volumes such as 1547*a*, it has been illustrated as an expanded nonstructural volume, i.e., a volume which has been expanded by a gas such as vaporized liquid nitrogen; however, it may comprise a material-filled nonstructural volume, i.e., a volume filled or otherwise defined by a liquid or solid material or element rather than a gas.

As shown in FIG. 16, the heat seals may either be quite narrow (see, e.g., the discrete locations 1583-1 and 1583-5) or they can bond a substantial area of the first and second layers 1580-1*a*, 1580-1*b* together (see, e.g., the discrete locations designated 1583-2, 1583-3, 1583-4), although, it is preferred to utilize narrow heat seals on opposite sides of each of the discrete locations 1583-2, 1583-3, 1583-4 since there is no need to seal the first and second layers 1580-1*a*, 1580-1*b* together throughout the entirety of the areas occupied by the structural support volumes and the surface elements.

Figure 20:
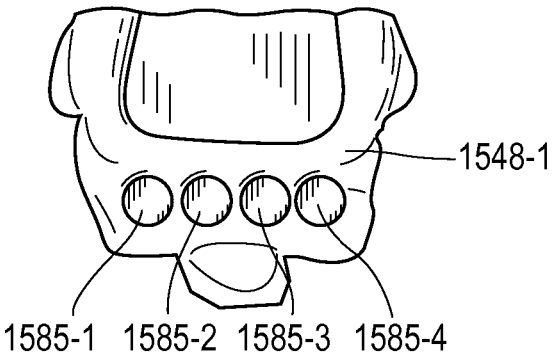
FIG. 20 illustrates a front view of the bottom end of the disposable flexible container that is more completely illustrated in FIG. 19.

Referring to FIGS. 16 and 20, it will be appreciated that the structural support volumes such as 1544-1, 1546-1, 1546-2, 1548-1 (and, as specifically shown in FIG. 20, the structural support volume 1548-1) each comprise a measurable volume when expanded, e.g., by inflating them with evaporated liquid nitrogen. One or more of the structural support volumes (e.g., the structural support volume 1548-1 in FIG. 20) also may include one or more heat seals such as 1585-1, 1585-2, 1585-3, 1585-4 bonding the double walls defined by the first and second layers 1580-1*a*, 1580-1*b* together. In this manner, the heat seals such as 1585-1, 1585-2, 1585.3, 1585-4 in FIG. 20, may reduce from about 0.1% to about 50% of the measurable volume and, preferably, from about 1% to about 40% of the measurable volume and, more preferably, from about 2% to about 35% of the measurable volume.

With regard to FIGS. 15, 18 and 19, the one or more surface elements on the nonstructural panel 1580-1 such as 1547*a*, 1547*b* in FIG. 15, 1547*a*, 1547*b*, 1547*c*, etc. in FIG. 18 and 1547*a*, 1547*b*, etc. in FIG. 19, or any other type, arrangement and size of similar surface elements in other embodiments, may comprise about 1% to about 100% or, preferably, about 1% to about 75%, or, more preferably, about 1% to about 50% or, still more preferably, about 1% to about 25% or, even more preferably, about 1% to about 10% of a total area defined by the nonstructural panel.

Also, with regard to FIGS. 15, 18 and 19, there is a ratio of area comprising the one or more surface elements such as 1547*a*, 1547*b* in FIG. 15, 1547*a*, 1547*b*, 1547*c*, etc. in FIG. 18 and 1547*a*, 1547*b*, etc. in FIG. 19 on the nonstructural panel 1580-1. Further, there is an area comprising the one or more flat spaces such as 1581-1*a* and 1581-1*b* in FIG. 15, 1581-1*a*, 1581-1*b*, 1581-1*c*, etc. in FIG. 18 and 1581-*a*, 1581-1*b*, 1581-1*c*, etc. in FIG. 19 on the nonstructural panel 1580-1. The ratio of area comprising the one or more surface elements to area comprising the one or more flat spaces is about 0.006 to about 115 and, preferably, about 0.01 to about 50 and, more preferably, about 0.07 to about 10.

Again referring to FIGS. 15, 18 and 19, the surface elements, such as 1547*a*, 1547*b* in FIG. 15, 1547*a*, 1547*b*, 1547*c*, etc. in FIG. 18 and 1547*a*, 1547*b*, etc. in FIG. 19, locally extend out in a direction substantially normal to the flat spaces, such as 1581-1*a* and 1581-1*b* in FIG. 15, 1581-1*a*, 1581-1*b*, 1581-1*c*, etc. in FIG. 18 and 1581-*a*, 1581-1*b*, 1581-1*c*, etc. in FIG. 19 on the nonstructural panel 1580-1, to a height or distance that is at least about 1 micrometer (μm) or any integer value for micrometers from about 1 to about 30,000 micrometers (μm).

Preferably, the surface elements in FIGS. 15, 18 and 19, or in any other embodiment in accordance with the disclosure, locally extend out in a direction normal to the flat spaces on the nonstructural panel to a height or distance that is in the range of about 100 to about 5,000 micrometers (μm), and more preferably, in the range of about 500 to about 1,000 micrometers (μm), With regard to all such surface elements, it is to be understood that are elements that are elements that are at least about 50% to about 100% surrounded by a flat space or spaces on a nonstructural panel but exclude applied surface features such as labels and shaped structures and the height or distance they locally extend is measured in a direction normal to the flat space substantially adjacent the surface element to the highest point of the surface element at any location along its length.

Still referring to FIGS. 15, 18 and 19, the disposable flexible container 1500 of any of these embodiments, or any other embodiments according to the disclosure including, but not limited to, FIGS. 1A-1D, may comprise a stand-up container. These embodiments will typically have a top end (e.g., 104 in FIGS. 1A-1B), a bottom end (e.g., 108 in FIGS. 1A-1B), and a left side and a right sides (e.g., 109 in FIGS. 1A-1B), In addition, these embodiments will typically include a base structure (e.g., 190 in FIGS. 1A-1B) for resting the bottom end 108 on any horizontal support surface so that it can stand upright as shown, e.g., in FIGS. 1A-1B, 15, 18 and 19-20.

As will be appreciated from FIGS. 15, 18 and 19, the nonstructural panel 1580-1 may have at least some irregular cross-sections when taken generally perpendicular to an outwardly facing surface of the nonstructural panel in a direction from the left side to the right side of the containers 1500 at various different points between the top end and the bottom end of the container and, as will also be appreciated from FIGS. 15, 18 and 19, the nonstructural panel 1580-1 may have at least some irregular cross-sections when taken generally perpendicular to an outwardly facing surface of the nonstructural panel in a direction from the top end to the bottom end of the containers 1500 at various different points between the left side and the right side of the container.

In all of the foregoing embodiments, the one or more structural support volumes such as 1544-1, 1546-1, 1546-2, 1548-1 will be seen to at least partially bound the one or more nonstructural volumes such as 1547*a*, 1547*b* in FIG. 15, 1547*a*, 1547*b*, 1547*c*, etc. in FIG. 18 and 1547*a*, 1547*b*, etc. in FIG. 19. Because the one or more structural support volumes at least partially bound the one or more nonstructural volumes, the containers 1500 are rendered substantially self-supporting independent of the one or more nonstructural volumes. Also, the containers 1500 each have a shape substantially defined by the one or more structural support volumes, and the containers have an outer surface texture defined at least in part by the one or more nonstructural volumes.

With regard to all embodiments, none of the one or more structural support volumes such as 1544-1, 1546-1, 1546-2, 1548-1 need be in fluid communication with any of the one or more nonstructural volumes such as 1547*a*, 1547*b* in FIG. 15, 1547*a*, 1547*b*, 1547*c*, etc. in FIG. 18 and 1547*a*, 1547*b*, etc. in FIG. 19.

As an alternative, at least one of the one or more structural support volumes such as 1544-1, 1546-1, 1546-2, 1548-1 may be in fluid communication with at least one of the one or more nonstructural volumes such as 1547*a*, 1547*b* in FIG. 15, 1547*a*, 1547*b*, 1547*c*, etc. in FIG. 18 and 1547*a*, 1547*b*, etc. in FIG. 19.

As a still further alternative, some or all of the one or more structural support volumes such as 1544-1, 1546-1, 1546-2, 1548-1 may be in fluid communication with some or all of the one or more nonstructural volumes such as 1547*a*, 1547*b* in FIG. 15, 1547*a*, 1547*b*, 1547*c*, etc. in FIG. 18 and 1547*a*, 1547*b*, etc. in FIG. 19.

In any embodiments, printed text may be present along with 3D surface elements. The text may appear on the inner or outer surface of any layer present. Due to the 3D relief of the 3D surface elements present, this can present challenges for the legibility of the text when reading from a fixed position and/or when viewing the package from a distance, such as for example, on a store shelf or in a vending machine.

Referring to FIG. 18, the nonstructural panel 1580-1 may have a printed text as at 1587 comprising a font or a language system of characters and/or numbers wherein the characters present have an average height measurement designated as "t". The average height "t" is an average of all of the characters present and is measured from the upper most extent of the character to the lowermost extent of the character. The nonstructural volume has a characteristic dimension "d" measured from border region to border region of the nonstructural volume in the direction of the printed text, e.g., as shown in FIG. 18. The dimensionless ratio t/d can be called the legibility ratio and, for some embodiments, can be in the range of about 0.01 to about 50, more preferably about 0.03 to about 10, still more preferably, about 0.1 to about 1.

The container 1500 in FIG. 18 will be seen to have a first (left) side 1509 and a second (right) side 1509 so the average height "t" can be determined by measuring the vertical height of all of the characters present when the printed text extends in a direction running generally from the first (left) toward the second (right) side, or vice versa, i.e., if the printed text runs generally horizontally. Alternatively, the container 1500 will also be seen to have a top end 1504 and a bottom end 1508 so the average height "t" can be determined by measuring the vertical height of all of the characters present when the printed text extends in a direction running generally from the top end toward the bottom end, or vice versa, if the printed text runs generally vertically. In either of these cases, the width dimension "d" of the nonstructural volume(s) in the region of printed text can be measured in the direction the printed text runs, i.e., horizontally when the printed text runs horizontally as shown in FIG. 18, and vertically when the printed text runs vertically which can be called the parallel legibility ratio. Alternatively, the width dimension "d" of the nonstructural volume(s) in the region of printed text can be measured perpendicular to the direction the printed text runs, i.e., vertically when the printed text runs horizontally as shown in FIG. 18, and horizontally when the printed text runs vertically which can be called the perpendicular legibility ratio.

Referring once again to FIGS. 15 and 16 as being illustrative, another feature of the disclosure is that the one or more structural support volumes such as 1546-1, 1546-2 at least partially bounding the one or more nonstructural volumes such as 1547*a* project outwardly further from the one or more flat spaces such as 1581-1*a*, 1581-1*b* on the nonstructural panel 1580-1 than the one or more nonstructural volumes.

In another respect, it will also be appreciated from FIG. 16 that the one or more structural support volumes such as 1546-1, 1546-2 and the one or more nonstructural volumes such as 1547*a* each have a measurable expanded volume. The measurable expanded volume of the one or more structural support volumes such as 1544-1, 1546-1, 1546-2, 1548-1 (see, also FIG. 15 as an illustrative embodiment) comprises from about 50% to about 99% of the combined measurable expanded volume of the one or more structural support volumes (1544-1, 1546-1, 1546-2, 1548-1) and the one or more nonstructural volumes 1547*a*, 1547*b*. Preferably, the measurable expanded volume of the one or more structural support volumes comprises from about 60% to about 99% and, more preferably, from about 65% to about 99%, of the combined measurable expanded volume of the one or more structural support volumes and the one or more nonstructural volumes.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: (1) U.S. non-provisional application Ser. No. 13/888,679 filed May 7, 2013, entitled "Flexible Containers" and published as US20130292353 (applicant's case 12464M); (2) U.S. non-provisional application Ser. No. 13/888,721 filed May 7, 2013, entitled "Flexible Containers" and published as US20130292395 (applicant's case 12464M2); (3) U.S. non-provisional application Ser. No. 13/888,963 filed May 7, 2013, entitled "Flexible Containers" published as US20130292415 (applicant's case 12465M); (4) U.S. non-provisional application Ser. No. 13/888,756 May 7, 2013, entitled "Flexible Containers Having a Decoration Panel" published as US20130292287 (applicant's case 12559M); (5) U.S. non-provisional application Ser. No. 13/957,158 filed Aug. 1, 2013, entitled "Methods of Making Flexible Containers" published as US20140033654 (applicant's case 12559M); and (6) U.S. non-provisional application Ser. No. 13/957,187 filed Aug. 1, 2013, entitled "Methods of Making Flexible Containers" published as US20140033655 (applicant's case 12579M2); (7) U.S. non-provisional application Ser. No. 13/889,000 filed May 7, 2013, entitled "Flexible Containers with Multiple Product Volumes" published as US20130292413 (applicant's case 12785M); (8) U.S. non-provisional application Ser. No. 13/889,061 filed May 7, 2013, entitled "Flexible Materials for Flexible Containers" published as US20130337244 (applicant's case 12786M); (9) U.S. non-provisional application Ser. No. 13/889,090 filed May 7, 2013, entitled "Flexible Materials for Flexible Containers" published as US20130294711 (applicant's case 12786M2); (10) U.S. provisional application 61/861,100 filed Aug. 1, 2013, entitled "Disposable Flexible Containers having Surface Elements" (applicant's case 13016P); (11) U.S. provisional application 61/861,106 filed Aug. 1, 2013, entitled "Flexible Containers having Improved Seam and Methods of Making the Same" (applicant's case 13017P); (12) U.S. provisional application 61/861,118 filed Aug. 1, 2013, entitled "Methods of Forming a Flexible Container" (applicant's case 13018P); (13) U.S. provisional application 61/861,129 filed Aug. 1, 2013, entitled "Enhancements to Tactile Interaction with Film Walled Packaging Having Air Filled Structural Support Volumes" (applicant's case 13019P); (14) Chinese patent application CN2013/085045 filed Oct. 11, 2013, entitled "Flexible Containers Having a Squeeze Panel" (applicant's case 13036); (15) Chinese patent application CN2013/085065 filed Oct. 11, 2013, entitled "Stable Flexible Containers" (applicant's case 13037); (16) U.S. provisional application 61/900,450 filed Nov. 6, 2013, entitled "Flexible Containers and Methods of Forming the Same" (applicant's case 13126P); (17) U.S. provisional application 61/900,488 filed Nov. 6, 2013, entitled "Easy to Empty Flexible Containers" (applicant's case 13127P); (18) U.S. provisional application 61/900,501 filed Nov. 6, 2013, entitled "Containers Having a Product Volume and a Stand-Off Structure Coupled Thereto" (applicant's case 13128P); (19) U.S. provisional application 61/900,508 filed Nov. 6, 2013, entitled "Flexible Containers Having Flexible Valves" (applicant's case 13129P); (20) U.S. provisional application 61/900,514 filed Nov. 6, 2013, entitled "Flexible Containers with Vent Systems" (applicant's case 13130P); (21) U.S. provisional application 61/900,765 filed Nov. 6, 2013, entitled "Flexible Containers for use with Short Shelf-Life Products and Methods for Accelerating Distribution of Flexible Containers" (applicant's case 13131P); (22) U.S. provisional application 61/900,794 filed Nov. 6, 2013, entitled "Flexible Containers and Methods of Forming the Same" (applicant's case 13132P); (23) U.S. provisional application 61/900,805 filed Nov. 6, 2013, entitled "Flexible Containers and Methods of Making the Same" (applicant's case 13133P); (24) U.S. provisional application 61/900,810 filed Nov. 6, 2013, entitled "Flexible Containers and Methods of Making the Same" (applicant's case 13134P); each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product volume, and configured to show the level of the fluent product in the product volume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment.

Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A disposable flexible self-supporting container for a fluent product, comprising:

a product volume for the fluent product at least partially defined by a nonstructural panel having at least one flat space;

one or more structural support members, wherein each structural support member includes an expanded structural support volume, which is a fillable space made from one or more flexible materials and is filled with one or more gases at a pressure greater than atmospheric pressure, wherein the one or more gases create tension in the one or more flexible materials;

one or more surface elements projecting outwardly from at least one of the flat spaces on the nonstructural panel, wherein the one or more surface elements comprise at least one nonstructural volume to define a finger rest on the nonstructural panel; and a dispenser for dispensing the fluent product from the product volume.

2. The disposable flexible self-supporting container of claim 1, wherein the nonstructural panel is a flexible squeeze panel.

3. The disposable flexible self-supporting container of claim 1, wherein the finger rest on the nonstructural panel is generally circular in shape.

4. The disposable flexible self-supporting container of claim 1, wherein the one or more surface elements on the nonstructural panel comprise about 1% to about 25% of a total area defined by the nonstructural panel.

5. The disposable flexible self-supporting container of claim 1, wherein the one or more surface elements locally extend out in a direction substantially normal to the at least one flat space on the nonstructural panel to a height or distance of from about 100 to about 20,000 micrometer (μm).

6. The disposable flexible self-supporting container of claim 1, wherein the container is a stand-up container.

7. A disposable flexible self-supporting container for a fluent product, comprising:

a product volume for the fluent product at least partially defined by a nonstructural panel having at least one flat space;

one or more structural support members, wherein each structural support member includes an expanded structural support volume, which is a fillable space made from one or more flexible materials and is filled with one or more gases at a pressure greater than atmospheric pressure, wherein the one or more gases create tension in the one or more flexible materials;

one or more surface elements projecting outwardly from at least one of the flat spaces on the nonstructural panel, wherein the one or more surface elements comprise a plurality of nonstructural volumes arranged to divide the nonstructural panel into multiple nonstructural sub-panels; and a dispenser for dispensing the fluent product from the product volume.

8. The disposable flexible self-supporting container of claim 7, wherein the nonstructural panel is a flexible squeeze panel.

9. The disposable flexible self-supporting container of claim 7, wherein the one or more surface elements on the nonstructural panel comprise about 1% to about 25% of a total area defined by the nonstructural panel.

10. The disposable flexible self-supporting container of claim 7, wherein the one or more surface elements locally extend out in a direction substantially normal to the at least one flat space on the nonstructural panel to a height or distance of from about 100 to about 20,000 micrometer (μm).

11. The disposable flexible self-supporting container of claim 7, wherein the container is a stand-up container.

12. A disposable flexible self-supporting container for a fluent product, comprising;

a product volume for the fluent product at least partially defined by a nonstructural panel having at least one flat space;

one or more structural support members, wherein each structural support member includes an expanded structural support volume, which is a fillable space made from one or more flexible materials and is filled with one or more gases at a pressure greater than atmospheric pressure, wherein the one or more gases create tension in the one or more flexible materials;

one or more surface elements projecting outwardly from at least one of the flat spaces on the nonstructural panel, wherein the nonstructural panel comprises a double wall defined by first and second layers; and a dispenser for dispensing the fluent product from the product volume.

13. The disposable flexible self-supporting container of claim 12, wherein the one or more surface elements comprise a pattern of nonstructural volumes projecting outwardly of the one or more flat spaces on the nonstructural panel.

14. The disposable flexible self-supporting container of claim 12, wherein the one or more surface elements each comprise an expanded nonstructural volume defined by the first and second layers.

15. The disposable flexible self-supporting container of claim 12, wherein the one or more surface elements each comprise a material-filled nonstructural volume between the first and second layers.

16. The disposable flexible self-supporting container of claim 12 wherein the first and second layers defining the double wall are joined at discrete locations to form at least one nonstructural volume comprising the one or more surface elements.

17. The disposable flexible self-supporting container of claim 12, wherein the nonstructural panel is a flexible squeeze panel.

18. The disposable flexible self-supporting container of claim 12, wherein the one or more surface elements on the nonstructural panel comprise about 1% to about 25% of a total area defined by the nonstructural panel.

19. The disposable flexible self-supporting container of claim 12, wherein the one or more surface elements locally extend out in a direction substantially normal to the at least one flat space on the nonstructural panel to a height or distance of from about 100 to about 20,000 micrometer (μm).

20. The disposable flexible self-supporting container of claim 12, wherein the container is a stand-up container.

* * * * *